US012509957B1

(12) United States Patent
Pirayeh Gar et al.

(10) Patent No.: US 12,509,957 B1
(45) Date of Patent: Dec. 30, 2025

(54) PARTIALLY BONDED SEALS FOR WELL SYSTEMS

(71) Applicant: Halliburton Energy Services, Inc., Houston, TX (US)

(72) Inventors: Shobeir Pirayeh Gar, Carrollton, TX (US); Xiaoguang Allan Zhong, Sinpapore (SG); Yian Zhao, Singapore (SG); Chee Sing Kelvin Loh, Singapore (SG); Abdolreza Gharesi, Singapore (SG)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/886,519

(22) Filed: Sep. 16, 2024

(51) Int. Cl.
*E21B 33/126* (2006.01)

(52) U.S. Cl.
CPC ..... *E21B 33/126* (2013.01)

(58) Field of Classification Search
CPC ..... E21B 33/04; E21B 33/0415; E21B 33/126
See application file for complete search history.

(56) References Cited

U.S. PATENT DOCUMENTS

| | | | | |
|---|---|---|---|---|
| 4,496,162 | A * | 1/1985 | McEver | E21B 33/1216 166/123 |
| 4,663,513 | A | 5/1987 | Webber | |
| 4,832,125 | A | 5/1989 | Taylor | |
| 4,919,460 | A | 4/1990 | Milberger et al. | |
| 5,303,518 | A | 4/1994 | Strickland | |
| 6,029,748 | A | 2/2000 | Forsyth et al. | |
| 6,098,717 | A | 8/2000 | Bailey et al. | |
| 6,378,606 | B1 | 4/2002 | Swor et al. | |
| 7,360,592 | B2 | 4/2008 | McMahan | |
| 9,580,981 | B2 | 2/2017 | Zhong et al. | |
| 10,337,298 | B2 | 7/2019 | Braddick | |
| 11,215,012 | B2 | 1/2022 | Chen et al. | |

(Continued)

FOREIGN PATENT DOCUMENTS

| | | |
|---|---|---|
| EP | 0289108 | 3/1992 |
| WO | 2011151139 | 12/2011 |

(Continued)

OTHER PUBLICATIONS

"Metal Seal Design Guide", Parker Hannifin Corporation, https://www.parker.com/content/dam/Parker-com/Literature/Seal-Group/CSS-5129.pdf, 2013, 106 pages.

(Continued)

*Primary Examiner* — David Carroll
(74) *Attorney, Agent, or Firm* — DeLizio, Peacock, Lewin & Guerra LLP

(57) ABSTRACT

Various seals for wellbore systems include a partially bonded seal configured to be actuatable to provide a fluid seal between a first conduit and a second conduit positioned within a wellbore. The partially bonded seal may comprise a hanger body and a sealing element, the sealing element positioned in contact with and arranged to encircle an outer surface of the hanger body for some longitudinal distance along the hanger body. A first portion of the sealing element adjacent to the outer surface of the hanger is bonded to the outer surface of the hanger body, and a second portion of the sealing element adjacent to the outer surface of the hanger body is not bonded to the outer surface of the hanger body.

20 Claims, 14 Drawing Sheets

(56) References Cited

U.S. PATENT DOCUMENTS

| | | | | |
|---|---|---|---|---|
| 11,225,000 | B2 | 1/2022 | Yu et al. | |
| 11,248,450 | B2 | 2/2022 | Hazelip | |
| 11,248,451 | B2 | 2/2022 | Sevadjian et al. | |
| 11,377,934 | B1 | 7/2022 | Gar et al. | |
| 2001/0045289 | A1 | 11/2001 | Cook et al. | |
| 2001/0047866 | A1 | 12/2001 | Cook et al. | |
| 2002/0014339 | A1 | 2/2002 | Ross | |
| 2002/0139540 | A1 | 10/2002 | Lauritzen | |
| 2003/0042022 | A1 | 3/2003 | Lauritzen et al. | |
| 2003/0047322 | A1 | 3/2003 | Maguire et al. | |
| 2003/0094768 | A1 | 5/2003 | Kamiya et al. | |
| 2004/0244994 | A1 | 12/2004 | Jackson et al. | |
| 2004/0256115 | A1 | 12/2004 | Vincent et al. | |
| 2005/0011650 | A1 | 1/2005 | Harrall et al. | |
| 2005/0028990 | A1 | 2/2005 | Atkins et al. | |
| 2005/0052019 | A1 | 3/2005 | Schroeder | |
| 2006/0266514 | A1 | 11/2006 | Abarca et al. | |
| 2007/0012439 | A1* | 1/2007 | McGuire | E21B 33/126 166/387 |
| 2007/0257486 | A1 | 11/2007 | Filippov et al. | |
| 2008/0011489 | A1* | 1/2008 | McGuire | E21B 33/126 166/387 |
| 2012/0205091 | A1* | 8/2012 | Turley | E21B 43/103 166/77.53 |
| 2012/0312542 | A1 | 12/2012 | Varghese et al. | |
| 2014/0020911 | A1 | 1/2014 | Martinez | |
| 2014/0174763 | A1 | 6/2014 | Zhong et al. | |
| 2015/0011650 | A1 | 1/2015 | Bartos et al. | |
| 2015/0068733 | A1 | 3/2015 | Dilber et al. | |
| 2016/0053591 | A1 | 2/2016 | Hallundbaek et al. | |
| 2016/0326830 | A1 | 11/2016 | Hallundbæk et al. | |
| 2016/0356131 | A1 | 12/2016 | Humphrey et al. | |
| 2017/0022775 | A1 | 1/2017 | Spitz et al. | |
| 2018/0045016 | A1 | 2/2018 | Radtke et al. | |
| 2018/0112486 | A1 | 4/2018 | Potts et al. | |
| 2018/0135369 | A1 | 5/2018 | Parekh et al. | |
| 2019/0316434 | A1 | 10/2019 | Davies et al. | |
| 2020/0173248 | A1 | 6/2020 | Yee et al. | |
| 2020/0370383 | A1* | 11/2020 | Hazelip | E21B 43/105 |
| 2021/0010353 | A1 | 1/2021 | Hazelip et al. | |
| 2021/0011576 | A1 | 1/2021 | Suto et al. | |
| 2021/0020263 | A1 | 1/2021 | Pasini et al. | |
| 2021/0087902 | A1 | 3/2021 | Saeed | |
| 2021/0115764 | A1 | 4/2021 | Zhong et al. | |
| 2021/0238933 | A1* | 8/2021 | Smith | E21B 43/105 |
| 2022/0145712 | A1 | 5/2022 | Bermudez et al. | |
| 2023/0003097 | A1 | 1/2023 | Vasques | |
| 2023/0374890 | A1 | 11/2023 | Zhong et al. | |
| 2023/0407730 | A1 | 12/2023 | Zhong et al. | |
| 2024/0117716 | A1 | 4/2024 | Zhong et al. | |

FOREIGN PATENT DOCUMENTS

| | | |
|---|---|---|
| WO | 2020185208 | 9/2020 |
| WO | 2022177939 | 8/2022 |

OTHER PUBLICATIONS

"O-Flex Metal Seal O-Rings", Technetics Group, https://technetics.com/products/o-flex-metal-seal/, 2023, 3 pages.

"PCT Application No. PCT/US2023/070087, International Search Report and Written Opinion", Apr. 2, 2024, 12 pages.

"PCT Application No. PCT/US2022/077934 International Search Report and Written Opinion", Jul. 11, 2023, 13 pages.

"PCT Application No. PCT/US2023/086224 International Search Report and Written Opinion", May 8, 24, 8 pages.

"U.S. Appl. No. 17/750,662 Final Office Action", Apr. 25, 2024, 9 pages.

"U.S. Appl. No. 17/750,807 Final Office Action", May 28, 2024, 29 pages.

"U.S. Appl. No. 18/045,618 Filed Application and Drawings", 26 pages.

"U.S. Appl. No. 18/045,618 Non Final Office Action", Nov. 28, 23, 14 pages.

"U.S. Appl. No. 18/045,618 Notice of Allowance", Jul. 15, 2024, 9 pages.

"U.S. Appl. No. 18/045,618 Office Action", Nov. 28, 2023, 15 pages.

Zhong, et al., "Performance Evaluation of a Large Bore Expandable Liner Hanger for Field Operations in the Gulf of Mexico", Offshore Technology Conference held in Houston, Texas, USA, May 4-7, 2015., May 2015, 14 pages.

"PCT Application No. PCT/US2024/049499 International Search Report and Written Opinion", Jun. 10, 2025, 11 pages.

* cited by examiner

PARTIALLY BONDED SEALS FOR WELL SYSTEMS

TECHNICAL FIELD

The present disclosure relates generally to wellbore systems, and, more particularly, to various embodiments of partially bonded seals for well systems.

BACKGROUND

As part of performing subterranean operations, a wellbore is typically drilled and completed to facilitate removal of desired materials (e.g., hydrocarbons) from a subterranean formation, and/or for storage of materials, such as carbon dioxide or hydrogen gas. Often, once a wellbore is drilled a casing may be inserted into the wellbore. The casing may consist of a metal tube enclosing a passageway extending through the casing. Once the casing is positioned within the wellbore, cement may then be used to install the casing in the wellbore and to prevent migration of fluids in the annulus between the casing and the wellbore wall. In certain implementations, the casing may be made of heavy steel.

Once an upper portion of the wellbore has been drilled and cased, it may be desirable to continue drilling to further extend the wellbore. It is often then desirable and/or necessary to line this extended portion of the wellbore with a liner that can be lowered through the upper cased portion of the wellbore. Liner hangers are typically used to mechanically support and couple an upper end of the liner from the lower end of a previously installed casing. Additionally, liner hangers may be used to seal the liner to the casing, forming a fluid seal between the upper end of the liner and the lower end of the casing. Additional liners may be lowered into the wellbore in order to continue to line the wellbore as the wellbore is extended into the subterranean formation.

BRIEF DESCRIPTION OF THE DRAWINGS

Embodiments of the disclosure may be better understood by referencing the accompanying drawings.

Figure 1A:
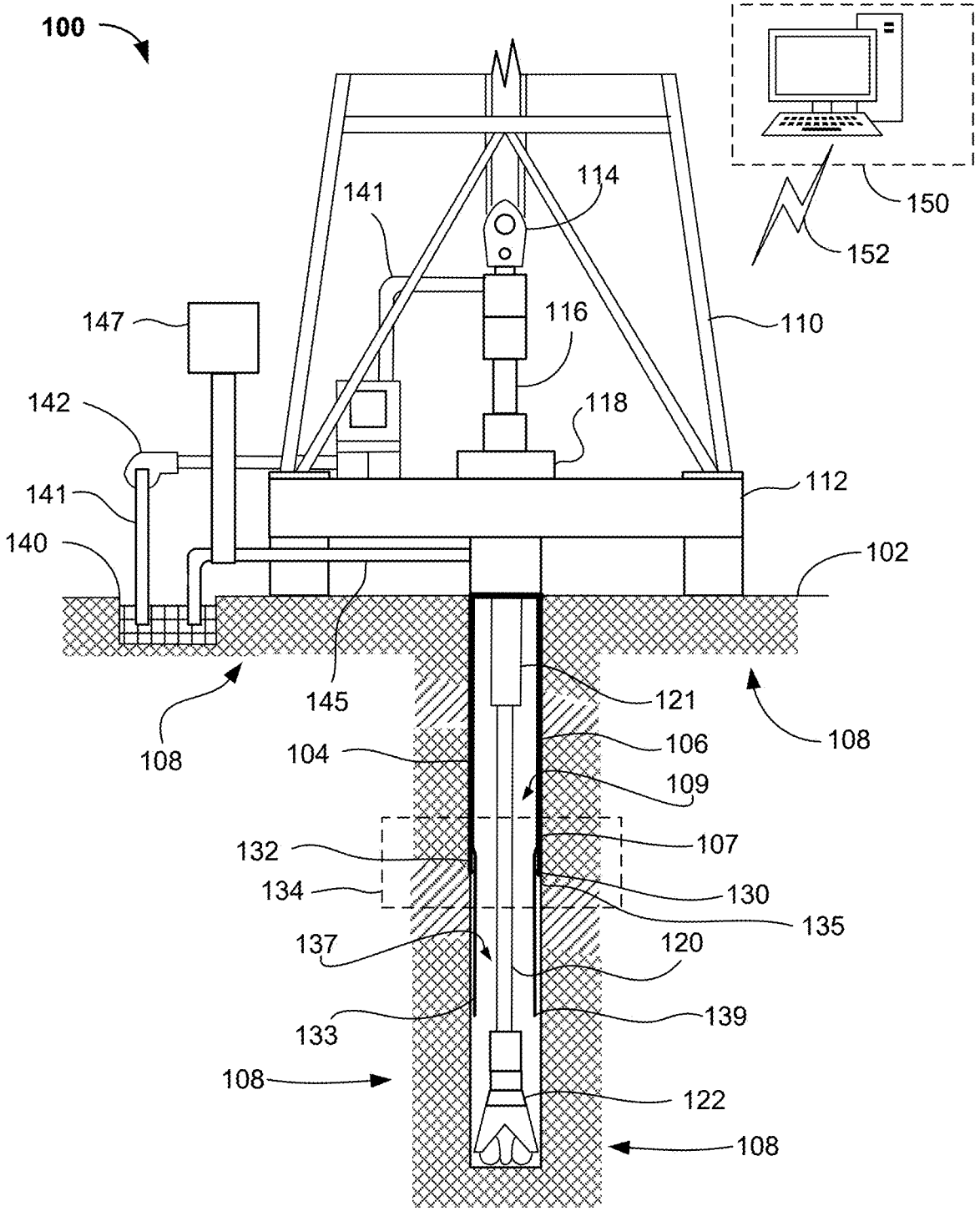
FIG. 1A illustrates a schematic diagram of a wellbore system including a partially bonded seal, in accordance with various embodiments.

The drawings are provided for the purpose of illustrating example embodiments. The scope of the claims and of the disclosure are not necessarily limited to the systems, apparatus, methods, or techniques, or any arrangements thereof, as illustrated in these figures. In the drawings and description that follow, like parts are typically marked throughout the specification and drawings with the same or coordinated reference numerals. The drawing figures are not necessarily to scale. Certain features of the invention may be shown to be exaggerated in scale or in somewhat schematic form, and some details of conventional elements may not be shown in the interest of clarity and conciseness.

DETAILED DESCRIPTION

The description that follows includes example systems, methods, techniques, and program flows that embody aspects of the disclosure. The description includes example embodiments of partially bonded seals configured to provide a seal between a portion of a wellbore casing and a wellbore liner. In various embodiments, the partially bonded seal is provided as part of a liner hanger that is coupled to or is adjacent to a distal portion a tubular shaped liner, the partially bonded seal configured to be actuatable once the liner hanger is positioned in a desired location relative to a wellbore casing or a previously installed liner, and when actuated the liner hanger is configured to provide a fluid seal between the outside of the liner and another surface, such as the inner surface of the wellbore casing or another liner where the partially bonded seal is positioned.

Fully bonded elastomeric seals have been successfully used in many downhole tools, particularly downhole tools experiencing large strokes when running downhole. However, performance of these fully bonded seals can be considerably degraded if the seal groove or seal carrier tube where the seal is located deforms radially inward under high pressures which may exist in a wellbore environment. This radially inward deformation may result in a drop of seal contact stress, which weakens the seal and eventually results in leakage. One application for the fully bonded seal is for use with expandable liner hangers (ELH), where the lower seal has been shown to be susceptible to high pressures from below the seal due to the radial deformation of the bottom liner hanger.

The above issue is not only an issue with fully bonded elastomeric or thermoplastic seals. Metal-to-Metal (MTM) seal performance can also be adversely affected when the seal carrier undergoes radially inward deformations due to high pressures resulting in a drop in seal contact stress. Moreover, arrangements of seals that utilize metal one or more metal spikes could be limited by collapse strength of the liner hanger and due to sealing surface wear.

This disclosure addresses the above design challenge by offering embodiments of an adaptive sealing method where the seal is attached to the spike(s) of an Expandable Liner Hanger (ELH), and in various embodiments comprises a mix of a sealing element having both a bonded surface and unbonded surface relative to the hanger outside diameter (OD), wherein these seals may also be referred to as "partially bonded seals." This disclosure describes embodiments of adaptive partially bonded seals, and methods for employing these partially bonded seals configured to compensate for the radially inward deformation of the seal carrier under high pressures, which thereby avoid excessive seal contact stress drop, thus maintaining the desired fluid seal when actuated in a wellbore environment.

In various embodiments, an adaptive seal includes a thermoplastic or an elastomeric material seal that is partially bonded and partially unbonded to the seal groove where the seal is located. In some embodiments, the seal is located in a recess between the metal spikes positioned along the outer surface of an end portion of a liner hanger. In various embodiments, the metal spike positioned adjacent to the unbonded side of the seal can be equipped with one or more fluid conduits configured to allow pressure to further engage the unbonded portion of the seal with a surface to which the seal is being asserted against in order to provide the fluid seal between a liner hanger and a casing or another liner positioned within a wellbore. The fluid pressure that is allowed to engage the unbonded portion of the seal results in a radially outward deformation of the unbonded portion of the seal, which compensates for the radially inward deformation of the seal carrier where the seal is located, for instance the body of a liner hanger forming the seal carrier. The radially outward deformation of the unbonded portion of the seal caused by the fluid pressured allowed to engage the unbonded portion of the seal results in the seal maintaining the required seal contact stress and seal robustness, and thereby preventing the leaks at the seal that might otherwise occur in instances where a fully bonded seal has been deployed.

As further discussed below, alternative embodiments of the partially bonded seal include a seal element made from a thermoplastic or an elastomeric material, and which incorporate one or more breakable or expandable bands configured to better control the seal flare-up action during run-in of the unactuated seal element, and an adaptive metal seal joined to the last hanger spike of a liner hanger. Features of the partially bonded seals include but are not limited to:

- The adaptive seal is partially bonded and partially unbonded to the seal groove on the liner hanger outer diameter (OD).
- The metal spike on the unbonded side of the adaptive seal may be drilled with fluid penetration holes.
- The metal spike on the unbonded side of the adaptive seal may be grooved to create one or more fluid conduits.
- The adaptive seal element may be formed from thermoplastic or elastomeric material, which offers a simplistic option.
- The adaptive seal element may be formed from elastomeric material or a thermo-plastic material with or without optional breakable or expandable bands configured to better control the flare-up of the seal during run-in.
- The adaptive seal may be formed from metallic material, in various embodiments the seal joined and bonded to the last spike of the liner hanger where the seal is located.

The proposed adaptive seals can resist high pressures, for example fluid pressures 10000 pounds-per-square inch (PSI) or approximately 68,900 Kilopascals (kPa) and above due to its self-energizing nature, without excessive loss of contact stress because the radially outward deformation of the unbonded portion of the seal compensates for the radially inward deformation of the seal carrier. Therefore, these adaptive seals can effectively maintain the contact stress and seal contact length required to prevent leakage under these high pressures when actuated in a downhole environment within a wellbore. Embodiments of the partially bonded seals as described herein provide one or more of the following advantages:

- Effective and easy-to-implement sealing method to resist high pressure in scenarios where the seal carrier undergoes radially inward deformation.
- Minimum deviation from legacy designs.
- Scalable and versatile concept for different hanger sizes.
- No tangible added cost.

It would be understood that embodiments of this disclosure may be practiced without all of the specific details as described herein. Further, while the wellbores as illustrated and described in the figures of this disclosure are shown as comprising a vertically oriented borehole and/or as a vertically oriented borehole coupled to a horizontally oriented borehole, embodiments of wellbores where the systems and methods as described in this disclosure may be deployed are not limited to wellbores having any particular orientation, and may include vertical, horizontal, and/or inclined wellbores, and combinations of these, including wellbore systems including one or more branches coupled to a main, a secondary, or other network(s) of a wellbore.

Unless otherwise specified, use of the terms "up," "upper," "upward," "uphole," "upstream," or other like terms shall be construed as generally away from the bottom, terminal end of a well; likewise, use of the terms "down," "lower," "downward," "downhole," or other like terms shall be construed as generally toward the bottom, terminal end of the well, regardless of the wellbore orientation. Use of any one or more of the foregoing terms shall not be construed as limited to denoting positions along a perfectly vertical axis. In some instances, a part near the end of the well can be horizontal or even slightly directed upwards. Unless otherwise specified, use of the term "subterranean formation" shall be construed as encompassing both areas below exposed earth and areas below earth covered by water, such as an ocean, or a body of fresh water.

Throughout this disclosure the terms "proximal" and "distal" are used to refer to a particular end portion of a device or element, such as a tubing or a borehole, which extend for some distance in a colinear or parallel direction relative to a longitudinal axis of the wellbore. The term "proximal" or "proximal end" refers to the end portion of the device or element that is closest to the wellhead of a wellbore when measured along the longitudinal axis of the wellbore and regardless of the actual distance from the wellhead. The term "distal" or "distal end" refers to the end portion of the device or element that is closest to the terminal end of a wellbore when measured along the longitudinal axis of the wellbore and regardless of the actual distance from the terminal end of the wellbore.

FIG. 1A illustrates a schematic diagram of a wellbore system ("system") 100, including a partially bonded seal 132, in accordance with various embodiments. As shown in FIG. 1A, system 100 includes a derrick 110 that is positioned on a platform 112 located above a surface 102 of a subterranean formation 108. Derrick 110 includes a hoist mechanism 114 coupled through a kelly 116 that is further coupled to a drillstring 120, the drillstring extending through a rotary table 118 positioned on platform 112 and into a wellbore 104 that extends from surface 102 into the subterranean formation 108. Drillstring 120 includes a drill collar 121 positioned at least partially within wellbore 104 just below surface 102, and a drill bit 122 positioned at the distal end of the drillstring. In various embodiments, rotary table 118 is configured to rotate the drillstring 120 in order to perform drilling operations using the drillstring and drill bit 122. In various embodiments, hoist mechanism 114 is configured to operate to raise and lower the drillstring 120 within wellbore 104, and/or to control the weight-on-bit being applied by the drill bit 122 during drilling operations.

During drilling operations being performed by system 100, one or more types of fluids, sometimes referred to as drilling fluid or "drilling mud," may be provided from a fluid reservoir 140 and pumped into the drillstring 120, for example using fluid pump 142, and through various configurations of interconnected fluid pipes 141. The drilling fluid may be pumped into drillstring 120 and is then provided to drill bit 122. The drilling fluid may be expelled through the drill bit 122 in order to remove debris and cuttings being generated by the drilling of the subterranean formation 108. The debris and cuttings being generated by the drilling operation(s) may be returned to the surface 102 for example through an annulus formed between a casing 106 that is lining the upper portion of the wellbore 104 and the subterranean formation 108 adjacent to the wellbore. The debris and/or cuttings being generated by the drilling operation(s) may be returned to the fluid reservoir 140 through return pipe 145. In some embodiments, the returning debris and/or cuttings may be processed and/or analyzed by processing equipment 147 before being returned to the fluid reservoir 140. In some embodiments, the drilling fluid can be used to cool the drill bit 122, as well as to provide lubrication for the drill bit during drilling operations.

Although wellbore 104 as illustrated in FIG. 1A is shown as having a single vertical wellbore, embodiments of system 100 may include any number of wellbores, and any configuration of connected wellbores, including one or more lateral wellbores that are oriented at some non-vertical orientation(s) and/or some non-horizontal orientation(s) relative to surface 102. In addition, as shown in FIG. 1A system 100 is illustrated as a terrestrial based system, but system 100 may include a wellbore system that extend through a body of water, such as a lake or an ocean, for some portion of the cased wellbore system.

As shown in FIG. 1A, an upper portion of wellbore 104 that extends from surface 102 is enclosed with the casing 106, which provides a passageway 109 through the casing, and wherein the casing has a downhole or distal end 107 located within the area of the wellbore indicated by dashed box 134. A proximal end 135 of a liner 133 is coupled to the distal end 107 of the casing 106 by a partially bonded seal 132 included as part of a liner hanger 130 that is positioned within the portion of the wellbore 104 indicated by dashed box 134 in FIG. 1A, wherein the liner 133 extends in a downhole direction from the liner hanger where the partially bonded seal and the distal end of casing 106 are located in order to further enclose an additional portion of the wellbore 104. The liner hanger 130 may be configured to support the proximal end 135 of the liner 133 relative to the casing 106, and provide the structure to support the partially bonded seal 132. The liner 133 encloses an additional portion of the wellbore 104, and provides a passageway 137 through the liner that couples with and extends the passageway 109 provided by the casing 106. Partially bonded seal 132 may include any of the sealing mechanisms described herein that incorporate a portion of a sealing element that is bonded to a hanger body of the liner hanger and a portion of the sealing element that is not bonded to the hanger body of the liner hanger, as further described below.

Although a single partially bonded seal 132 and one liner 133 are shown in FIG. 1A, embodiments of system 100 are not limited to having one liner and a single associated partially bonded seal, and may include a plurality of liners coupled together using respective sets of partially bonded seals in order to enclose additional portions of the wellbore 104 as the wellbore is further extended into the subterranean formation 108 as part of drilling operation(s) being performed by system 100. As an illustrative example, an initial drilling operation performed by system 100 may begin the drilling of wellbore 104 at surface 102 using drillstring 120. When the drilling operation has reached the area within the subterranean formation 108 indicated by dashed box 134, the drilling operation may be paused, the drillstring 120 removed from the wellbore, and the casing 106 is installed. The drilling of wellbore 104 may then continue by reinserting drillstring 120 into the existing wellbore 104 and through the passageway 109 created by casing 106.

With drillstring 120 reinserted into the wellbore 104, the drilling operation(s) may continue until wellbore 104 is further advanced into the subterranean formation 108 past the distal end 107 of casing 106. At some point the drilling operation may again be paused, the drillstring 120 removed from wellbore 104, and liner 133 inserted into the wellbore through casing 106. An operation to position liner hanger 130 within the borehole and to actuate the partially bonded seal 132 provided with the liner hanger may be performed, for example using a downhole tool (not specifically shown in FIG. 1A, but see seal expansion tool 170, FIG. 1), in order to actuate the partially bonded seal 132 and thereby provide a fluid seal between the distal end 107 of casing 106 and the proximal end 135 of the liner 133. In various embodiments, once the liner 133 has been installed and partially bonded seal 132 has been actuated, the drillstring 120 may be reinserted into wellbore 104 to extend through the collinear passageways 109 and 137 created through both the casing 106 and the liner 133, respectively, wherein the drilling operation(s) may be continued in order to further extend the wellbore into the subterranean formation 108 and beyond the distal end 139 of liner 133.

This process of pausing the drilling operation(s) in order to install a section of liner and actuating the partially bonded seals may be repeated any number of times, wherein one or more of the additional liners being installed within the wellbore may be coupled together using embodiment(s) of the partially bonded seals having a bonded portion and an unbonded portion, as further described herein. As shown in FIG. 1A and as described above, one or more liners may be added to a casing in order to extend the enclosed portion of a wellbore as a drilling operation is performed in order to advance the wellbore into a formation. The use of the liners provides stability to the walls of the wellbore, and because of the partially bonded seals used to provide a fluid seal between individual liners and/or a liner and a casing, control over the flow of fluids being provided into and out of the wellbore, such as a drilling fluid, may be maintained, while still allowing various tools, such as a drillstring, to be inserted into the wellbore and operate at areas within the wellbore that are beyond the distal end of the most distal liner provided within the wellbore. For example, the partially bonded seals that are associated with the liners provide a fluid seal which prevents the drilling fluid containing debris and cuttings that are being extracted from the wellbore using the annulus formed between the casing and/or the liner hanger(s) positioned within the wellbore from reentering the passageways (e.g., passageways 109, 137) extending though and formed within the wellbore by the casing and/or by the liners.

Use of the liner hangers 130 and partially bonded seal 132 for coupling liners together, or for coupling a liner to a casing, is not limited to use during drilling operations. In various embodiments, portions of the casing and/or the liner(s) positioned within a wellbore may be perforated for the purpose of allowing fluids to be injected into the wellbore for treatment and/or fracturing purposes. These same or other perforations provided within the casing and/or the liners that are positioned within a wellbore may also be used to extract a fluid, such as oil or gas, from the formation in the area of the wellbore. The use of the partially bonded seals and the liner hanger(s) as describe herein may be utilized in conjunction with other devices, such as packer devices, to properly control the flow of these treatment, fracturing, and/or extraction fluids as part of the further operations being performed on or by a wellbore system following the drilling of the well(s).

In various embodiments, system 100 includes one or more computer systems, such as computer system 150. Computer system 150 in various embodiments includes one or more processors and computer memory configured to store and operated programming designed to control the operations of system 100, such as but not limited to any drilling operation (s) and/or operations related to the installation of casings and/or liners within the wellbore. Other operations that may be controlled by computer system 150 include well treatment, fracturing, and resource extractions procedures being performed on wellbore 104 of system 100. In various embodiments, computer system 150 is configured to receive data, such as sensor data and/or other logging data, which has been generated by the operation of system 100. In various embodiments, computer system 150 is configured as a user interface that allows programming instructions to be entered into the computer system and then provided from computer system 150 and communicated to the devices, such as but not limited to motors, pumps, hoist mechanisms, rotary tables, and/or downhole tools included in the drillstring 120 in order to control the operation of system 100. Operations that may be controlled by computer system 150 include positioning of liners within the wellbore, and actuation of the partially bonded seals, for example using a seal expansion tool, to provide the fluid seals between a liner and a wellbore casing and/or between additional sections of liner being added to the wellbore below the casing. Communications to and/or from computer system 150 and other devices is illustratively represented in FIG. 1A by lightning bolt 152, which may include wired and/or wireless communications performed using any number of communication protocols.

Computer system 150 may include one or more computer processors, one or more memory devices, and one or more input/output devices, such as but not limited to a computer keyboard, computer mouse, and/or a display monitor, which may also function as a touch screen, and all of which allow a user, such as an engineer or field technician, to interact with system 100 in order to access operational data generated by the system and/or to control the overall operation of the system. In various embodiments, computer system 150 may be located on site near the wellbore where the drilling operations or other well system operations are being performed, and may be communicatively coupled to one or more remote devices that may be located off site.

Figure 1B:
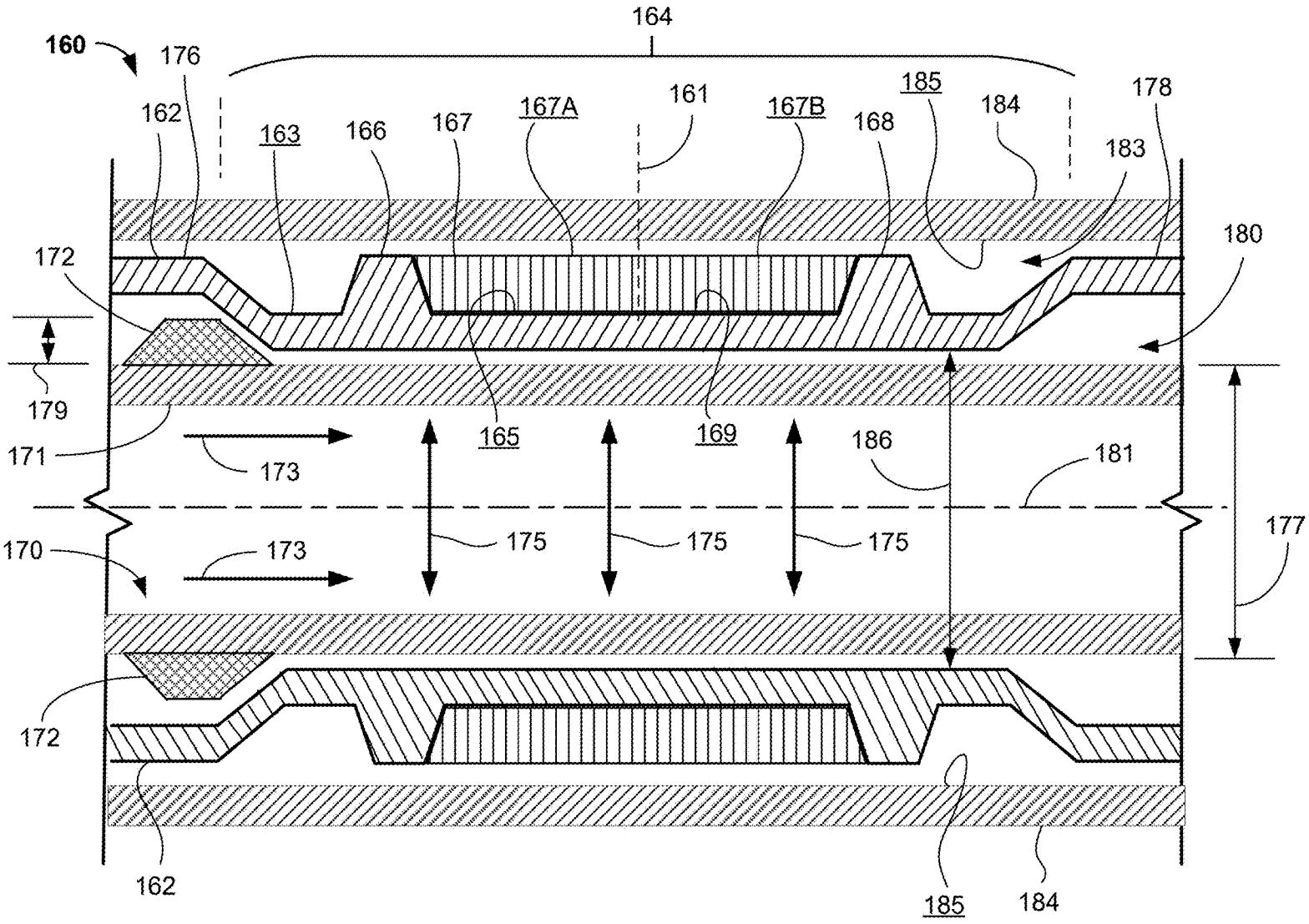
FIG. 1B illustrates a cutaway view of a partially bonded seal including a seal actuation tool configured to actuate the partially bonded seal, in accordance with various embodiments.

FIG. 1B illustrates a cutaway view of a partially bonded seal 160 including a seal expansion tool 170 configured to actuate the partially bonded seal, in accordance with various embodiments. Partially bonded seal 160 may be an embodiment of the partially bonded seal 132 as illustrated and described above with respect to FIG. 1A, and may be configured to provide any combination of the features and to perform any combination of the functions described above with respect to partially bonded seal 132 and system 100.

As shown in FIG. 1B, partially bonded seal 160 includes a liner hanger 162 having a tubular shape that extends around and encircles a portion of a longitudinal axis 181, forming a passageway 180 extending through the liner hanger 162. Liner hanger 162 includes a reduced diameter portion of the hanger body, generally indicated by bracket 164 in FIG. 1B. The reduced diameter portion of the liner hanger 162 has a diameter 186 in cross section that is smaller than the diameter of the liner that is located longitudinally outside of the reduced diameter portion. Within the reduced diameter portion of the liner hanger, the outer surface 163 of the liner hanger 162 includes a first metal spike 166 located adjacent the proximal end 176 of the liner hanger, a second metal spike 168 located at a distal end 178 of the liner hanger, and a sealing element 167 that extends along the outer surface 163 between the first metal spike and the second metal spike. In various embodiments, sealing element 167 is formed from a single piece of material.

Sealing element 167 includes a first portion 165 of a bottom surface of the sealing element that is physically bonded to the outer surface 163 of the liner hanger 162, and a second portion 169 of the bottom surface of the sealing element that is not bonded to but may be in physical contact with and/or adjacent to the outer surface 163 of the liner hanger. As illustrated in FIG. 1*i*, the first portion 165 extends from a distally facing surface of the first metal spike 166 to a point along the outer surface 163 indicated by dashed line 161, and wherein the second portion 169 extends from dashed line 161 in a distal direction longitudinally to a proximally facing surface of the second metal spike 168. This arrangement of the first portion 165 and the second portion 169 of the sealing element 167 locates the non-bonded second portion of the sealing element proximate to the area where fluid pressure, illustratively indicated by arrow 183, will occur once the partially bonded seal 160 has been actuated and one or more operations that involve fluid pressures are being performed in the wellbore where the partially bonded seal is located. The partially bonded seal 160 is configured to be actuated, as further described below, in order to create a seal between the liner hanger 162 and an inner surface 185 of a casing 184 that is positioned adjacent to the partially bonded seal within a wellbore.

In various embodiments, a seal expansion tool, such as seal expansion tool 170, is utilized to actuate the partially bonded seal 160 in order to form the seal between the sealing element 167 and the casing 184. As shown in FIG. 1B, seal expansion tool 170 includes a tool body 171 and an expansion cone 172. Tool body 171 may be tubular in shape and having an outer diameter 177 that allows the tool body to be inserted into and pass through the passageway 180 created within the partially bonded seal 160 and within the reduced diameter portion, generally indicated by bracket 164, of the liner hanger 162. Embodiments of the tool body 171 include an expansion cone 172 that encircles the outer surface of the tool body 171, and has a height dimension 179 that, in conjunction with the outer diameter 177 of the tool body 171, positions at least a portion of the expansion cone at a distance from the longitudinal axis 181 that is greater than the diameter 186 in cross-section of the reduced diameter portion of the hanger body.

Beginning at a location proximal of the reduced diameter section of liner hanger 162, the seal expansion tool 170 is configured to be advanced along longitudinal axis 181 in a distal direction as indicated by arrows 173. As the seal expansion tool 170 is advanced in the distal direction, expansion cone 172 engages the liner hanger 162, and forces the portion of the liner hanger within the reduced diameter section to expand outward radially, as illustratively represented by arrows 175. The outward expansion of the liner hanger 162 also moves sealing element 167 outward radially, causing the top surfaces 167A and 167B of sealing element 167 to be brought into contact with the inner surface 185 of casing 184. As shown in FIG. 1B, top surface 167A is opposite the first portion 165 of a bottom surface of the sealing element 167, and top surface 167B is opposite the second portion 169 of the bottom surface of the sealing element. The material used to form the liner hanger 162, such as a metal, is configured to be permanently deformed by the operation of the seal expansion tool 170 and the expansion cone 172 expanding outwardly the reduced diameter section of the liner hanger 162, and thereby maintaining a level of sealing pressure between the top surfaces 167A and 167B of the sealing element 167 and the inner surface 185 of casing 184 once the expansion tool has been used to actuate the sealing element. The overall outer diameter of the seal expansion tool 170 based on the outer diameter 177 of the tool body and the height dimension 179 of the expansion cone is specifically configured to provide the proper amount of expansion, and thus the desired amount of contact pressure, between the sealing element 167 and the inner surface 185 of the casing 184 once the seal expansion tool 170 has been operated to expand and actuate the partially bonded seal 160.

As shown in FIG. 1B, expansion cone 172 may have ramped surface, for example facing proximally and distally on the sides of the expansion cone, which act as lead-in surfaces for advancing the expansion cone against the reduced diameter section of liner hanger 162 during actuation of the sealing element, and for ease in extracting the seal expansion tool 170 from the passageway 180 and from the wellbore where the partially bonded seal 160 is located once the actuation of the partially bonded seal has been completed. Furter, as shown in FIG. 1B the expansion cone 172 is formed from a singular ring shaped piece of material. However, in various embodiments the expansion cone 172 may comprise more than one ring shaped piece and/or may be formed from multiple individual pieces of material combined and/or staked together to form the expansion cone. In various embodiments, some portion of the expansion cone 172 may be formed as a collapsible portion that allows for easier retraction of the seal expansion tool 170 upon completion of the seal setting process.

Upon completion of the actuation of the partially bonded seal 160, the seal expansion tool 170 may be removed from the passageway 180, and well operation(s) may be performed that may include fluid pressures appearing at the distal end 178 of the actuated partially bonded seal, for example as indicated by arrow 183 in FIG. 1B, which are sealed against further migration in the proximal direction along the inner surface 185 of the casing 184 by sealing element 167. As further described below, the configuration of the sealing element 167 having the unbonded second portion 169 of the sealing element allows the fluid pressure that may be present in the area just distal of the partially bonded seal to increase the sealing force available between the top surface 167B of the sealing element 167 and the inner surface 185 of casing 184, thus providing an improved seal compared to other sealing elements that do not incorporate both the bonded and the unbonded portions of the sealing element.

Figure 2A:
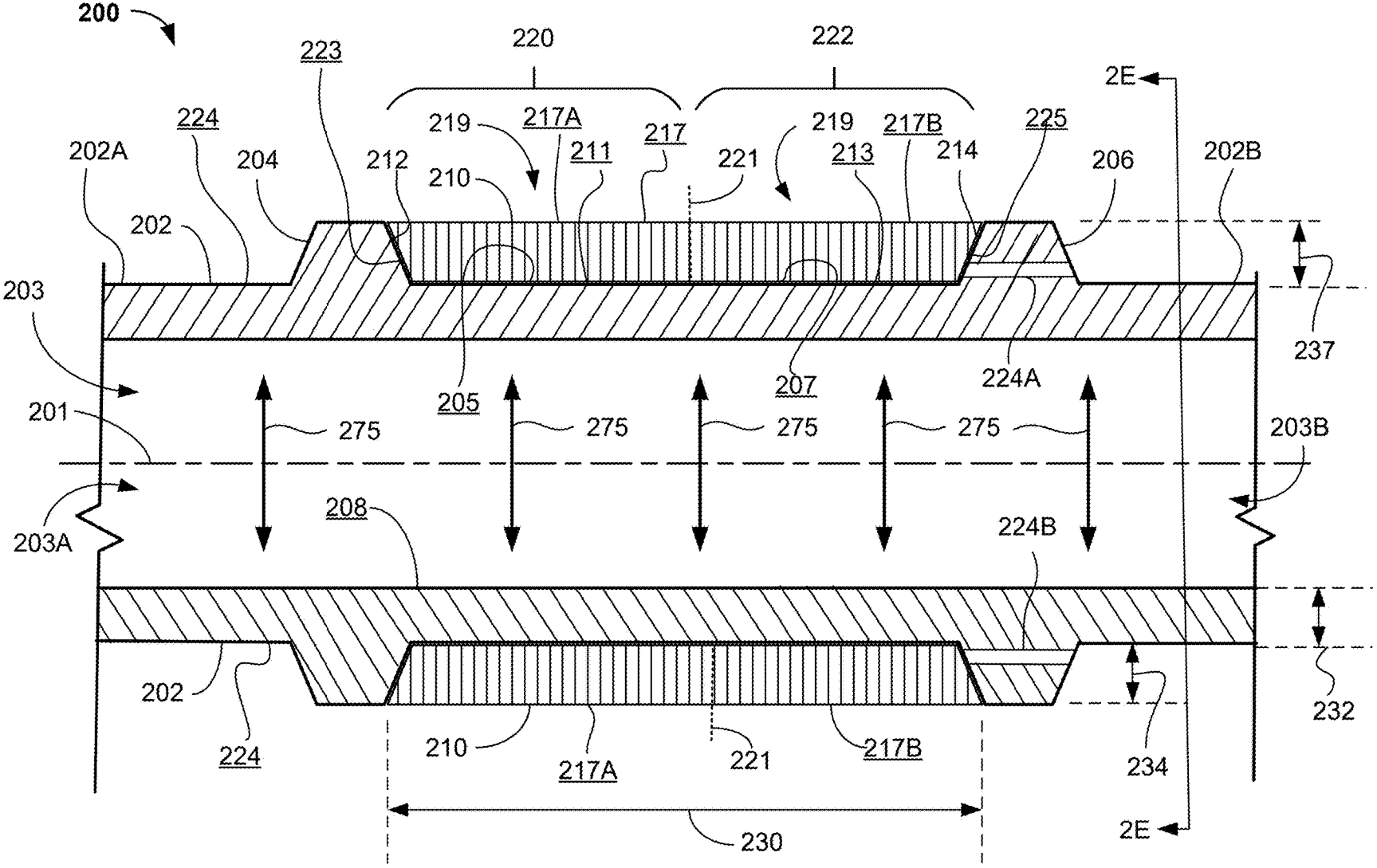
FIG. 2A illustrates a cutaway view of a partially bonded seal for providing a fluid pressure seal within a wellbore system, in accordance with various embodiments

FIG. 2A illustrates a cutaway view of a partially bonded seal 200 for providing a fluid pressure seal within a wellbore system, in accordance with various embodiments. Partially bonded seal 200 may be an embodiment of partially bonded seal 132 and/or 160, as illustrated and described above with respect to FIG. 1A and FIG. 1B, and may be configured to provide any combination of the features and to perform any combination of the functions described above with respect to partially bonded seals 132 and 160.

Features of the partially bonded seal 200 may include an adaptive seal comprising a sealing element formed from thermo-plastic material, such as Polytetrafluoroethylene (PTFE), or an elastomeric material, such as rubber, which is partially bonded and partially unbonded to the seal groove or recess 219 formed to encircle the outer surface 224 of a hanger body 202 included as part of a liner hanger, such as liner hanger 130 (FIG. 1). The seal groove or recess 219 in some embodiments is formed between the metal spikes in a liner hanger. In various embodiments, the metal spike proximate the unbonded side of the seal may be drilled with one or more fluid penetration holes, or machined with one or more grooves, to allow fluid pressure to further actuate the unbonded portion of the sealing element once the sealing element has been positioned downhole in a wellbore and actuated. When fluid pressure is received at these fluid penetration holes or grooves, some amount of radially outward deformation of the unbonded portion of the seal caused by the fluid pressure compensates for the radially inward deformation of the seal carrier, for instance the hanger body, resulting in the ability of the partially bonded seal to maintain the required seal contact stress and seal robustness.

As shown in FIG. 2A, partially bonded seal 200 includes a hanger body 202 that extends along and encircles a longitudinal axis 201. In various embodiments, hanger body 202 is formed from a ductile metal material, such as a low alloy steel, or 4140 steel. Hanger body 202 forms a passageway 203 that extends through the length of the partially bonded seal 200 along longitudinal axis 201, which may be referred to as a "liner passageway." Hanger body 202 includes an inner surface 208 that is generally cylindrical in cross-section, and extends along and encircles longitudinal axis 201, thereby partially enclosing the passageway 203 but providing a first opening 203A at the proximal end 202A of hanger body 202, and providing a second opening 203B at the distal end 202B of the hanger body. As shown in FIG. 2A, hanger body 202 includes an outer surface 224 that is spaced at a distance that is radially farther away from longitudinal axis 201 relative to the inner surface 208 of the hanger body, thereby providing a thickness dimension 232 to the hanger body along some portions of the hanger body longitudinally.

In various embodiments, sealing element 210 is positioned within the recess 219 formed along outer surface 224 and between a first metal spike 204 and a second metal spike 206, each of which extends radially away from longitudinal axis 201, and wherein the recess 219 and both the first metal spike 204 and the second metal spike 206 encircle some portion, longitudinally, of the longitudinal axis 201. First metal spike 204 and second metal spike 206 may extends radially away from the outer surface 224 to include a height dimension 234, 237, and incorporate a portion of the outer surface 224 extending over and along the ramped surfaces of each of the metal spikes 204 and 206.

Sealing element 210 may be formed from a flexible and/or a deformable material that when compressed, as further described below, is configured to provide a fluid seal between the hanger body 202 and another surface, such as a wellbore casing (not specifically shown in FIG. 2A, but for example casing 106, FIG. 1A). Sealing element 210 may be formed from a single piece of material, with portions as described herein. As shown in FIG. 2A, sealing element 210 includes a proximal end 212 configured to face toward and contact a distal facing surface 223 of the first metal spike 204, and a distal end 214 configured to face toward a proximally facing surface 225 of the second metal spike 206. A bottom surface 211 of the sealing element 210 extends along a first portion 205 of the outer surface 224 of the hanger body 202 and over a first portion of the recess 219 generally indicated by bracket 220, while a bottom surface 213 of the sealing element extends along a second portion 207 of the outer surface 224 of the hanger body and over a second portion of the recess 219, generally indicated by bracket 222. A first top surface portion 217A of the sealing element 210 extends from the proximal end 212 of the sealing element to dashed line 221, and a second top surface portion 217B of the sealing element 210 extends from dashed line 221 to the distal end 214 of the sealing element. The first top surface portion 217A and the second top surface portion 217B provide the surfaces that may be brought into contact with a surface or surfaces of another device, such as surface(s) of a casing or another liner, and are configured to form a fluid seal between the hanger body 202 and the surface(s) of these other devices.

In various embodiments, the bottom surface 211 of the sealing element 210 is bonded to the first portion 205 of the outer surface 224 of the hanger body 202 within recess 219 generally indicated by bracket 220. In addition, in various embodiments the proximal end 212 of the sealing element 210 is physically bonded to the distal facing surface 223 of the first metal spike 204. Bonding of these surfaces of the sealing element 210 may be provide by an adhesive element, which may vary depending on the type of material used to form the sealing element 210.

In various embodiments, the bottom surface 213 of sealing element 210 is not bonded to the second portion 207 of the outer surface 224 of the hanger body 202 within recess 219 that is generally indicated by bracket 222. In various embodiments, bottom surface 213 may be in physical contact with at least some portion of the outer surface 224 that extends through the second portion 207 of the recess 219 generally indicated by bracket 222, or may be positioned adjacent to the outer surface 244, but is not bonded with the outer surface. In addition, in various embodiments the distal end 214 of the sealing element 210 may be in physical contact with the proximally facing surface 225 of the second metal spike 206, but is not physically bonded the proximally facing surface 225.

As shown in FIG. 2A, sealing element 210 fills the recess 219 from the outer surface 224 of the hanger body 202 to a top surface 217 of the sealing element 210, and between the distal facing surface 223 of the first metal spike 204 to the proximally facing surface 225 of the second metal spike 206, and encircling the outer surface 224 around the entirety of the recess 219 radially. In various embodiments, sealing element 210 is formed from a singular piece of tubular shaped material. The portion of the sealing element 210 including bottom surface 211 is bonded to the outer surface 224 of the hanger body 202 within recess 219 extending over the first portion 205 that extends between the distal facing surface 223 and the position within recess 219 indicated by dashed line 221. The portion of the sealing element 210 that includes bottom surface 213 is not bonded to the outer surface 224 of hanger body 202 within recess 219 over the second portion 207 of the outer surface 224, and extends distally from the position indicated by dashed line 221 to the proximally facing surface 225 of the second metal spike 206.

The positioning of dashed line 221, and thus the relationship between the portion of the sealing element 210 that is bonded to the outer surface 224 and the portion of the sealing element that is not bonded to the outer surface 224 may be such that the bonded and unbonded portion of the sealing element each represent fifty (50) percent of the length 230 of the sealing element. However, other proportions of bonded versus non-bonded portions of the sealing element 210 may be provided, such as but not limited to a sixty-forty or a seventy-thirty proportions, depending on the application, including embodiments where a larger or a smaller portion of the sealing element 210 is bonded verses not bonded to the outer surface 224 of the hanger body 202. In various embodiments, the length of the unbonded portion of the sealing element 210 may be calculated and selected such that the radially inward deformation of the seal carrier (hanger body 202) can be compensated by the radially outward deformation of the unbonded portion of the sealing element in order to form the required seal contact stress and contact length. In various embodiments, Finite Element Analysis (FEA) may be used to determine the required unbonded length of the sealing element.

In various embodiments, in order to make the portion of the unbonded sealing element, the typical surface bonding treatment within the unbonded region over second portion 207 of the hanger body 202 is omitted, and instead that portion of the hanger body is smoothed and polished. In addition, an appropriate release agent or coating to avoid bonding, such as silicon-based sprays, wax-based coatings, oil-based films, etc., may be applied to the portion of the hanger body where the unbonded sealing element will be located. The choice of the release agent may depend on the type of the sealing element material being utilized. Implementing the unbonded surface may also be done through bond barriers such as a layer of silicon or dissolvable material.

As shown in FIG. 2A, embodiments of partially bonded seal 200 include fluid passageways 224A and 224B extending through the downhole positioned second metal spike 206. These fluid penetration passageways may be distributed around the circumference of the second metal spike 206 as needed. Each of the fluid penetration passageways provides fluid communication for fluid pressure present downhole of and adjacent to the outer surface 224 of the hanger body 202. When fluid pressure is present it is communicated through the fluid passageways, for example fluid passageways, 224A and 224B, and thereby applies fluid pressure along the unbonded bottom surface 213 and the unbonded distal end 214 of the sealing element 210, thus adding an outward force on the unbonded portion of the sealing element that increases the sealing force provided between at least some portion of top surface 217 of the sealing element 210 and another surface that is in contact with the top surface 217, such as an inner surface of a casing, against which the partially bonded seal has been actuated to seal against.

In various embodiments, actuation of the partially bonded seal 200 may include deforming the hanger body 202 in a manner that moves the inner surface 208 and the thickness dimension 232 of the hanger body 202 in a direction that is further away radially from longitudinal axis 201, and thus extends the outer surface 224 of the sealing element 210 in a direction that is farther away from the longitudinal axis 201 in all directions radially, as illustratively indicated by arrows 275. This expansion of the hanger body 202 can be used to bring at least some portion or portions of the top surface 217 of the sealing element 210 into physical contact with a surface of another element, such as a casing of a wellbore, and thereby form a fluid seal between the hanger body 202 and the element that has been brought into contact with the top surface 217 of the sealing element.

In various embodiments, sealing element 210 comprises a material formed from a thermo-plastic material, such as PTFE, or an elastomeric material such a rubber, which is partially bonded and partially unbonded to the outer surface 224 of the hanger body 202. In various embodiments, to make part of the seal unbonded, the typical surface bonding treatment within the second portion 207 of the unbonded region of the recess 219 is not done, and instead smooth and polish the portion of the outer surface 224 that extends within the recess and to which the sealing element is unbonded, and then apply an appropriate release agent or coating to avoid bonding. The release agent or coting may comprise such compounds as silicon-based sprays, wax-based coatings, oil-based films, etc. The choice of the release agent may depend on the type of the material used to form the sealing element 210. Implementing unbonded surface can also be done through bond barriers such as a layer of silicon or dissolvable material.

Figure 2B:
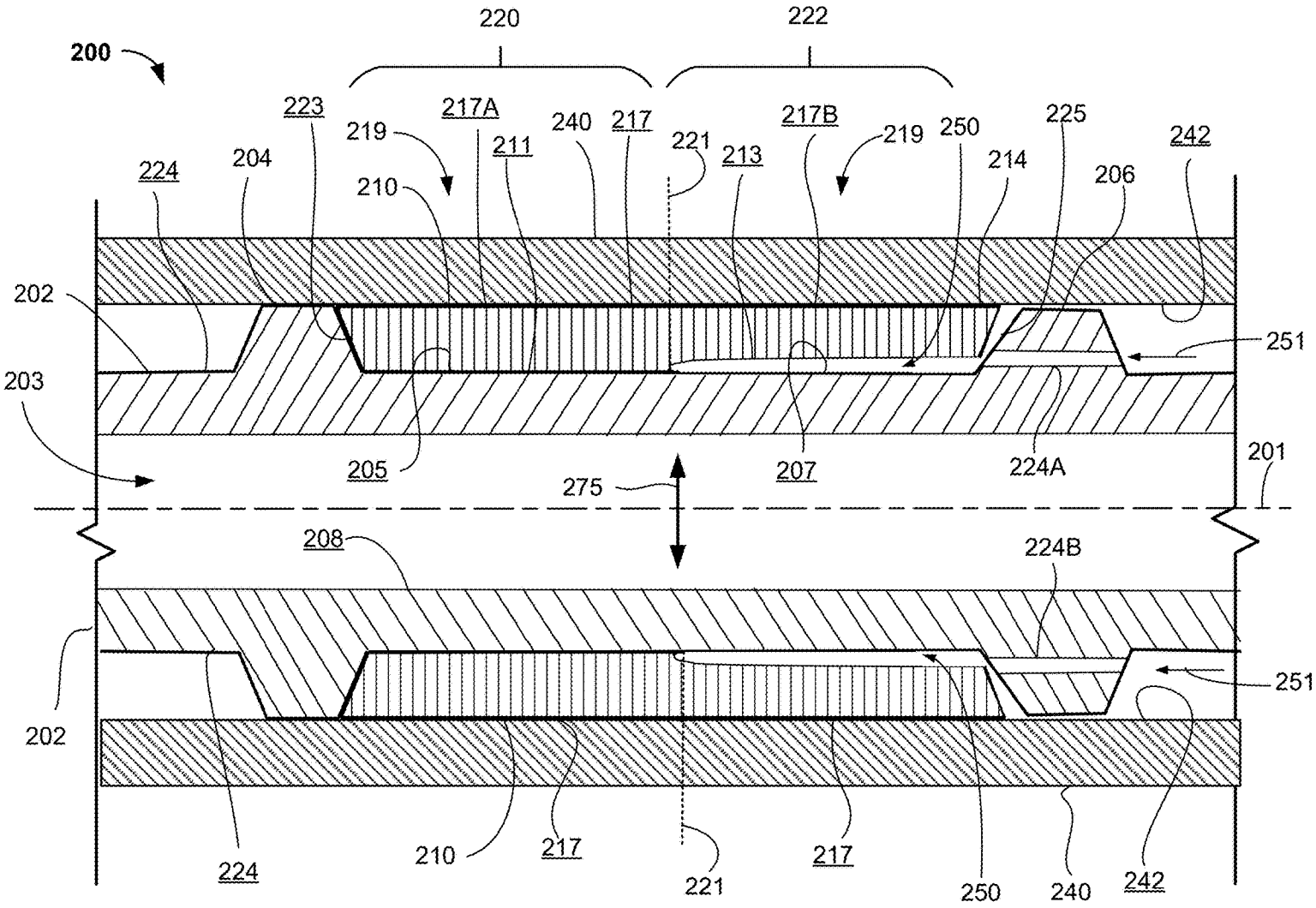
FIG. 2B illustrates a cutaway view of the partially bonded seal of FIG. 2A after actuation of the partially bonded seal has occurred, in accordance with various embodiments.

FIG. 2B illustrates a cutaway view of the partially bonded seal 200 of FIG. 2A after actuation of the partially bonded seal has occurred, in accordance with various embodiments. For the sake of clarity and simplicity not every reference number utilized in FIG. 2A to describe partially bonded seal 200 are necessarily reproduced in FIG. 2B. Differences between the configuration of partially bonded seal 200 of FIG. 2A and partially bonded seal 200 as shown in FIG. 2B are described below. Unless otherwise specified, all of the features may be present, and any of the functions ascribed to the partially bonded seal 200 of FIG. 2A, may configured to be provided by the partially bonded seal 200 of FIG. 2B.

As shown in FIG. 2B, partially bonded seal 200 has been actuated, (for example as illustrated and described above with respect to FIG. 1), so that the top surface 217 of the sealing element 210 has been brought into contact with a portion of the inner surface 242 of a casing 240 positioned adject to and surrounding the partially bonded seal. The contact between the top surface 217 of the sealing element 210 and the inner surface 242 of the casing 240 provides a fluid seal between the hanger body 202 and the casing. As also illustrated in FIG. 2B, the bonded portion of the partially bonded seal 200 as generally indicated by bracket 220, including the bottom surface 211 of the partially bonded seal, remains bonded to and in physical contact with the first portion 205 of the outer surface 224 of hanger body 202 within the recess 219. In addition, first top surface portion 217A of sealing element 217 has been brought into physical contact with a portion of the inner surface 242 of casing 240, while the proximal end 212 of the sealing element 210 remains bonded to the distal facing surface 223 of the first metal spike 204.

However, due to the presence of fluid pressure at the distal side of the second metal spike 206, (wherein the fluid pressure is illustratively represented arrow 251), the fluid pressure is communicated to the distal end 214 of sealing element 210 through fluid passageways 224A and 224B. Bottom surface 213 of the sealing element 210 has separated away from the second portion 207 (generally indicated by bracket 222) of the outer surface 224 of the hanger body 202, creating gap 250. In addition, the fluid pressure has caused the distal end 214 of the sealing element 210 to move in a proximal direction away from the proximally facing surface 225 of the second metal spike 206, there by generating an additional gap space that allows fluid pressure to also be exerted against the surface at the distal end 214 of the sealing element.

The fluid pressure present in gap 250 presses on the bottom surface 213 of the sealing element 210, thereby providing additional sealing force between the top surface 217B of the sealing element and the inner surface 242 of casing 240. In addition, the fluid pressure present in gap 250 may also apply a compressive force on the distal end 214 of the sealing element 210, adding additional sealing force to the area of contact between the top surface 217 of the sealing element and the inner surface 252 of casing 240 at both the first top surface portion 217A and at the second top surface portion 217B. By using a partially bonded and partially unbonded arrangement for the sealing element 210, and by allowing fluid pressure to be communicated through the fluid passageways 224A, 224B of the distal metal spike 206, additional sealing force may be applied by the sealing element 210 to the inner surface 242 of the casing 240, and thereby provide a fluid seal capable of sealing again higher fluid pressures that may be present within a wellbore at various times during the operation of the well system where the wellbore is located. Although described with respect to sealing against the inner surface of a casing, in various embodiments, the fluid seal as depicted in FIG. 2B may also be utilized to provide a fluid seal between the hanger body 202 of FIG. 2B and a surface of another liner utilized to extend the encasing of a wellbore.

Figure 2C:
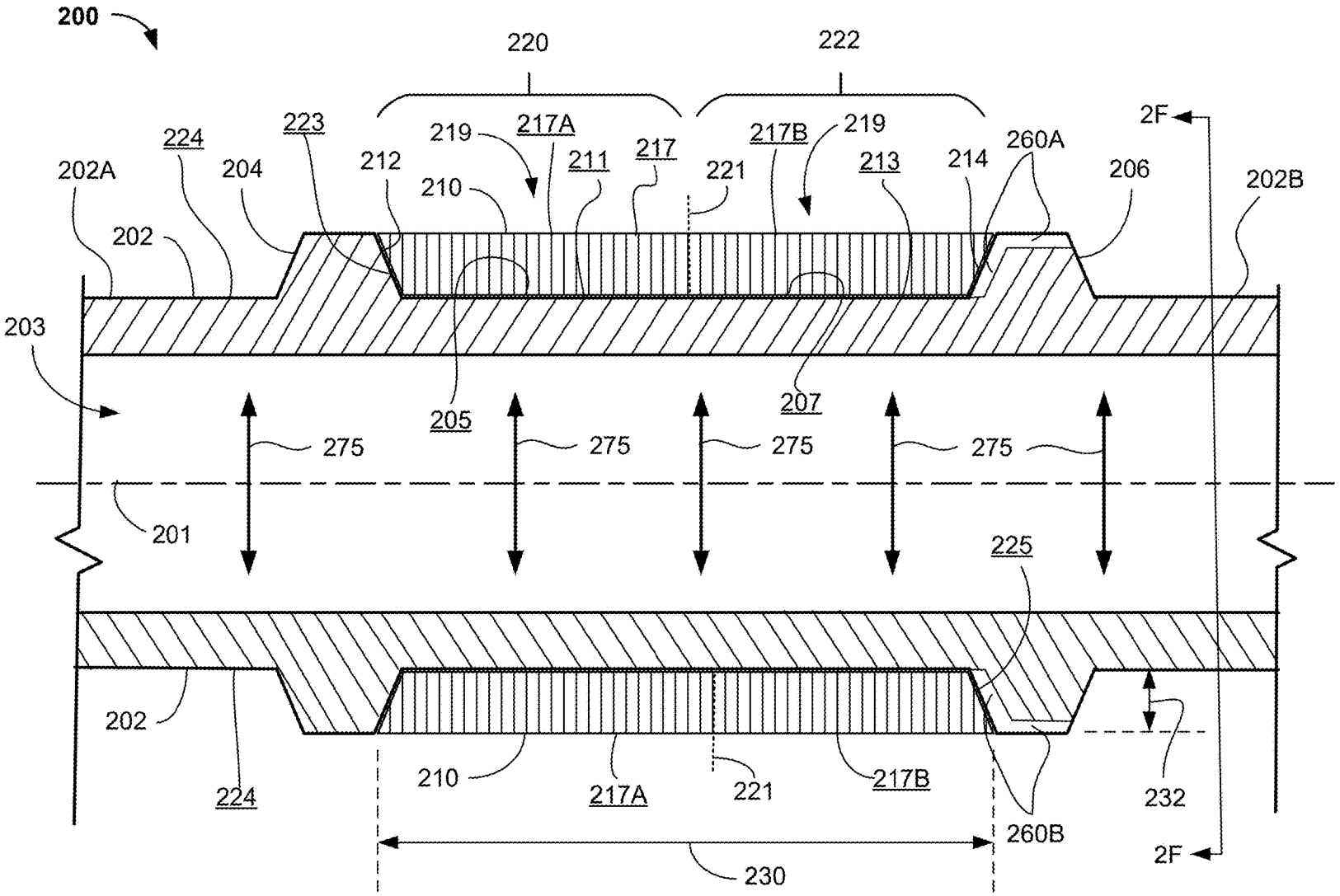
FIG. 2C illustrates a cutaway view of embodiments of the partially bonded seal of FIG. 2A in an unactuated configuration, in accordance with various embodiments.

FIG. 2C illustrates a cutaway view of embodiments of the partially bonded seal 200 of FIG. 2A in an unactuated configuration, in accordance with various embodiments. For the sake of clarity and simplicity not every reference number utilized in FIG. 2A to describe partially bonded seal 200 are reproduced in FIG. 2C. Differences between the configuration of partially bonded seal 200 of FIG. 2A and partially bonded seal 200 as shown in FIG. 2C are described below. Unless otherwise specified, all of the features may be present, and any of the functions ascribed to the partially bonded seal 200 of FIG. 2A, may be configured to be provided by the partially bonded seal 200 of FIG. 2C. Embodiments of partially bonded seal 200 as illustrated and described with respect to FIG. 2C may be utilized as the partially bonded seal included as partially bonded seal 132 in system 100, or any variation and/or equivalent thereof.

In FIG. 2C, the fluid passageways 224A and 224B as provided in FIG. 2A are replaced with pressure conduits 260A-B. Pressure conduits 260A-B may comprise a set of individual grooves extending across and below the top surface of the second metal spike 206 to be in fluid communication with at least the distal end 214 of the sealing element 210. In various embodiments, one or more of the pressure conduits 260A-B may also extend from the top of the second metal spike 206 and along the proximally facing surface 225 of the second metal spike. Pressure conduits 260A-B may be configured to perform a same or similar function of allowing fluid pressure present outside of the distal side of the second metal spike 206 to be communicated to the distal end 214 and to the unbonded bottom surface 213 of the sealing element 210. Once the sealing element 210 of FIG. 2C has been actuated to form a fluid seal with another surface, such as an inner surface of a casing or another liner, and fluid pressure is present at the distal side of the second metal spike 206, the pressure conduits 260A-B are configured to allow the fluid pressure to be communicated to the distal end 214 the sealing element 210, and thereby increase the sealing force being exerted by the top surfaces 217 of the sealing element 210, including both the first top surface portion 217A and the second top surface portion 217B, in a same or similar manner as described above with respect to FIG. 2B.

Figure 2D:
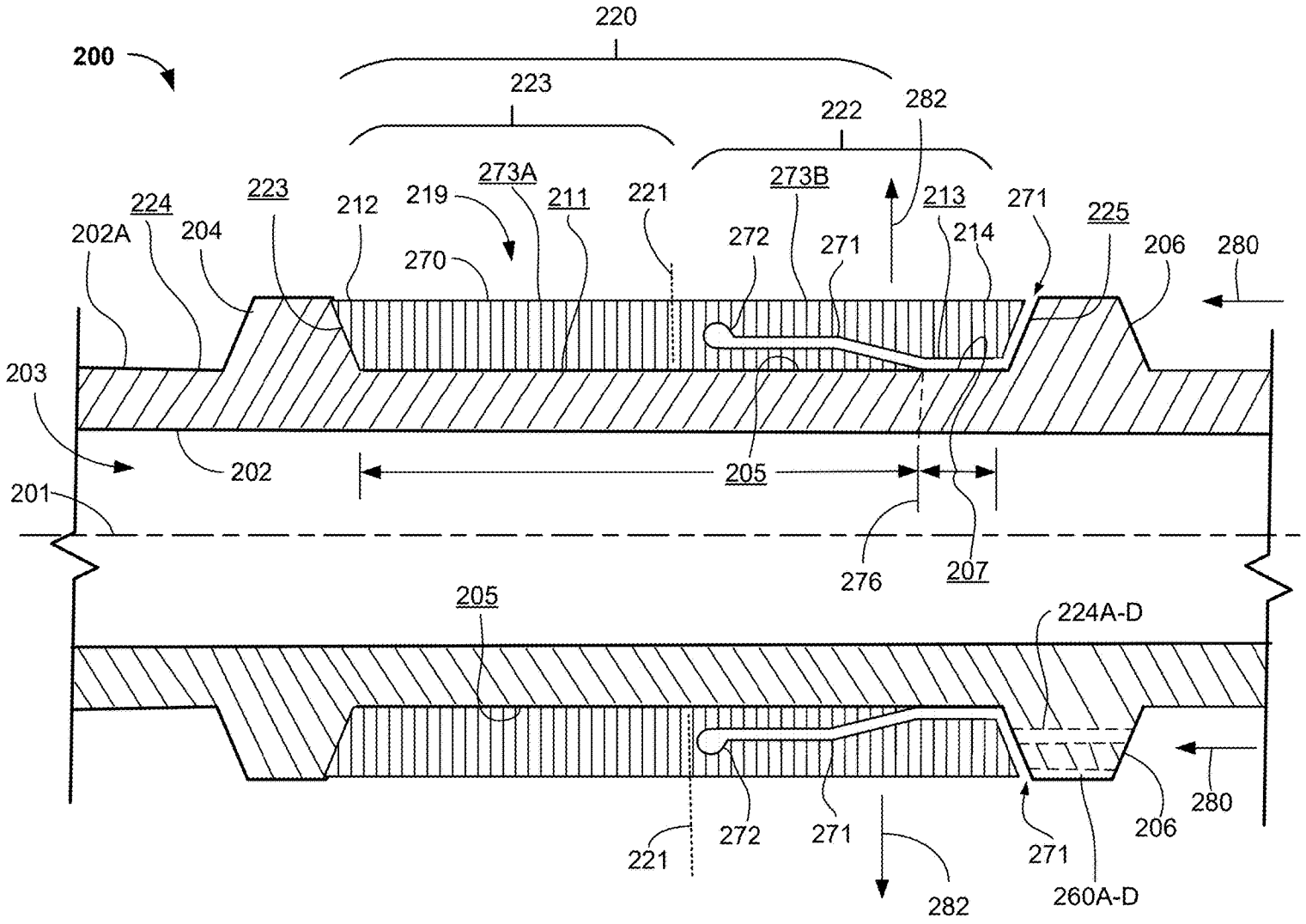
FIG. 2D illustrates a cutaway view of embodiments of the partially bonded seal of FIG. 2A in an unactuated configuration, in accordance with various embodiments.

FIG. 2D illustrates a cutaway view of embodiments of the partially bonded seal 200 of FIG. 2A in an unactuated configuration, in accordance with various embodiments. For the sake of clarity and simplicity not every reference number utilized in FIG. 2A to describe partially bonded seal 200 are reproduced in FIG. 2D. Differences between the configuration of partially bonded seal 200 of FIG. 2A and partially bonded seal 200 as shown in FIG. 2D are described below. Unless otherwise specified, all of the features may be present, and any of the functions ascribed to the partially bonded seal 200 of FIG. 2A, may configured to be provided by the partially bonded seal 200 of FIG. 2D. Embodiments of partially bonded seal 200 as illustrated and described with respect to FIG. 2D may be utilized as the partially bonded seal included as partially bonded seal 132 in system 100, or any variation and/or equivalent thereof.

In FIG. 2D, the sealing element 210 as provided in FIG. 2A is replaced with sealing element 270 configured as shown in FIG. 2D and as further described below. As shown in FIG. 2D, sealing element 270 extends within recess 219 and encircles hanger body 202 for some length along the longitudinal axis 201. A proximal end 212 of the sealing element is in physical contact with and bonded to the distal facing surface 223 of first metal spike 204. The bottom surface 211 of sealing element 270 is bonded to the first portion 205 of the outer surface 224 hanger body 202 along the entire length of the first portion 205 extending between the first metal spike 204 and the point along the first portion 205 of the outer surface 224 of the hanger body 202, as indicated by line 276 as generally indicated by bracket 220. A distal end 214 of the sealing element 270 is positioned adjacent to but not in contact with and not bonded to the proximally facing surface 225 of second metal spike 206. As shown in FIG. 2D, a passageway 271 separates the distal end 214 of the sealing element 270 from the proximally facing surface 225 of the second metal spike 206. Passageway 271 extends from the top surface of the second metal spike 206 to the second portion 207 of the outer surface 224 of the hanger body 202. Passageway 271 further extends for a distance along the second portion 207 of the hanger body, and then extends away from the bottom surface of the hanger body at the point along the bottom surface of the hanger body indicated by line 276 to form an additional passageway 271 extending proximally into the sealing element 270. In various embodiments, passageways 271 terminates within the sealing element 270 at a rounded shaped cavity 272 that is enclosed within the sealing element. The bottom surface 213 of sealing element 270 is separated from the second portion of the outer surface 224 of the hanger body 202 by the portion of passageway 271 the runs along the second portion 207, and thus is not bonded to and is not in physical contact with second portion 207. Passageway 271 and cavity 273 are generally indicated by bracket 222, wherein the passageway 271 and cavity 272 extend proximally of dashed line 276, thereby resulting in an overlap area between brackets 220 and 222.

The positioning of passageway 271 is configured to allow fluid pressure, illustratively represented by arrows 280 in FIG. 2D, which may be present on the distal side of the second metal spike 206 to be communicated through the passageway 271, and further into passageway 271 and cavity 272, once the partially bonded seal 200 including sealing element 270 has been actuated to form a fluid seal with another conduit, such as a casing or another liner. When actuated against another surface, such as the inner surface of a conduit or another liner, first top surface portion 273A (generally indicated by bracket 220) and top surface 273B (as generally indicated by bracket 222) are configured to be in physical contact with the surface of the casing or another liner. Following actuation of the partially bonded seal 200 of FIG. 2D and when fluid pressure is present (as illustratively represented by arrows 280), the communication of the fluid pressure into passageway 271, along with fluid pressure communicated into cavity 273, allows for further upward pressure, as illustratively represented by arrows 282, to be applied by top surface 273B of the sealing element 270 to the inner surface of the casing or liner against with the fluid seal is being formed, and thereby provide a stronger and more robust seal between the hanger body and the casing or other liner that can withstand higher fluid pressures than current prevailing hangers.

In addition to providing a stronger fluid seal, the extension of the bonded portion of the sealing element 270 to a more distal point (indicted by line 276) beyond dashed line 221 works to minimize the risk of losing the bonded surface once the fluid pressure (as illustratively represented by arrows 280) appear distally of the partially bonded seal. Once fluid pressure is applied to the partially bonded seal as described above, the wedge shape at the edge of the bonded surface of sealing element 270 at line 276 will be compressed radially downward, thereby reducing the chance of losing the bonded surface. In various embodiments, the bond barrier layer can be made with two or more segments (circumferentially) for ease of installation.

Embodiments of the partially bonded seal 200 that utilize sealing element 270 may incorporate one or more fluid passageways 224A-B, as illustrated and described above with respect to FIG. 2A and FIG. 2E. Embodiments of the partially bonded seal 200 that utilize sealing element 270 may incorporate one or more pressure conduits 260A-D as illustrated and described above with respect to FIG. 2C and FIG. 2F. In embodiments utilizing fluid passageways 224A-B and/or pressure conduits 260A-D allow fluid pressure (as illustratively represented by arrows 280) present at the distal side of the second metal spike 206 to be communicated to passageway 271 and to cavity 273, and thereby increasing the sealing force being applied by the sealing element 270 to a surface of another conduit positioned adjacent to the top surface of the sealing element.

Figure 2E:
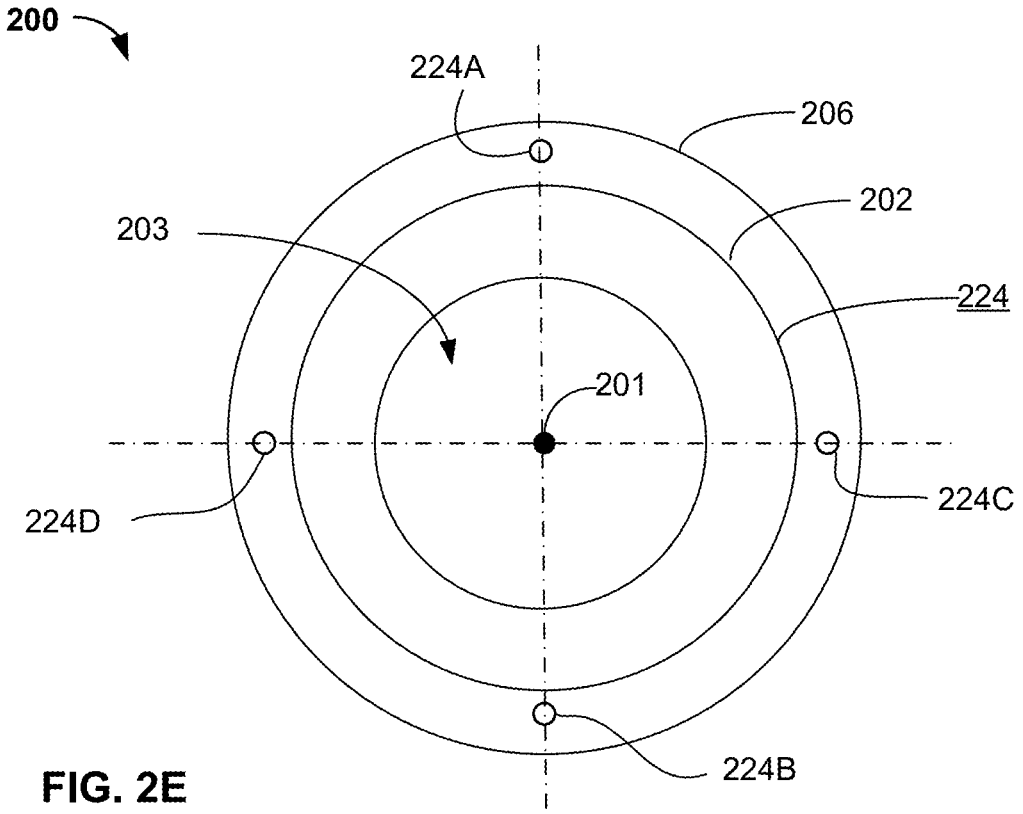
FIG. 2E illustrates a cross-sectional view of the partially bonded seal of FIG. 2A taken along line 2E-2E, in accordance with various embodiments.

FIG. 2E illustrates a cross-sectional view of partially bonded seal 200 of FIG. 2A taken along line 2E-2E, in accordance with various embodiments. As shown in FIG. 2E, hanger body 202 encircles the longitudinal axis 201 and forms passageway 203 within the hanger body. Second metal spike 206 extends radially away from the outer surface 224 of the hanger body 202, wherein the distally facing surface of the second metal spike includes a set of four fluid passageways 224A, 224B, 224C, and 224D. Each of the fluid passageways 224A-224D extend from the distally facing surface of the second metal spike 206 to the proximally facing surface 225 of the second metal spike, and provide a pathway for fluid communication between the distally facing surface and the proximally facing surface of the second metal spike. Fluid pressure that is communicated to the proximal side of the second metal spike through the fluid passageways 224A-D may provide an added force to the unbonded portion of the sealing element positioned adjacent to the proximal side of the second metal spike, and thereby increase the sealing force being applied by the top surfaces of both the unbonded portion and the bonded portion of the sealing element as described above.

The embodiment of the partially bonded seal 200 as depicted in FIG. 2E includes a total of four fluid penetration passageways that are spaced evenly apart from each other around the distally facing surface of the second metal spike 206 at a spacing of ninety degrees (90°) radially. However, embodiments of the fluid penetration passageways included in a partially bonded seal may comprise a smaller positive number or a larger positive number of passageways other than four. In addition, in various embodiments the spacing between the fluid penetration passageways is not limited to being evenly spaces apart radially around the distally facing surface of the second metal spike. In some embodiments, the fluid penetration passageways may be arranged in groupings of two or more fluid penetration passageways that are closer together to one another compared to other fluid penetration passageways included in a different grouping passageways included in the second metal spike. The fluid passageways 224A-224D as illustrated in FIG. 2E are circular in shape in cross-section. However, the shape of any one of the fluid penetration passageways is not limited to a circular shaped passageway, and may be another shape, such as but not limited to square, rectangular, elliptical, triangular, or some other closed polygonal shape in cross-section.

Figure 2F:
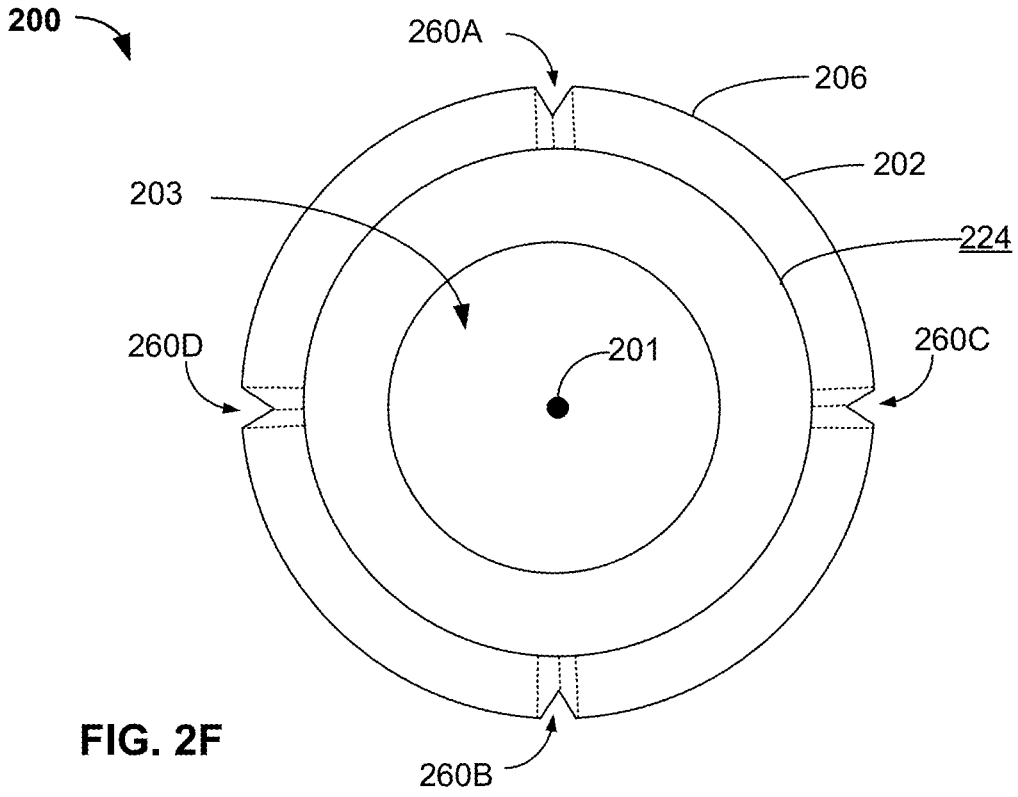
FIG. 2F illustrates a cross-sectional view of the partially bonded seal of FIG. 2C taken along line 2F-2F, in accordance with FIG. 3A illustrates a cutaway view of a partially bonded seal, in accordance with various embodiments.

FIG. 2F illustrates a cross-sectional view of partially bonded seal 200 of FIG. 2C taken along line 2F-2F, in accordance with various embodiments. As shown in FIG. 2F, hanger body 202 encircles the longitudinal axis 201 and forms passageway 203 within the hanger body. Second metal spike 206 extends radially away from the outer surface 224 of the hanger body 202, wherein the distally facing surface of the second metal spike includes a set of four pressure conduits 260A, 260B, 260C and 260D. Each of the pressure conduits 260A-260D extends across a top surface of the second metal spike 206, between the distally facing surface and the proximally facing surface of the second metal spike, and provides a pathway for fluid communication between the distally facing surface and the proximally facing surface of the second metal spike. In various embodiments, the pressure conduits further extends from the top surface of the second metal spike downward toward the longitudinal axis 201 along the proximally facing surface of the second metal spike, as shown by the dashed lines extending from the grooves forming pressure conduits 260A-260D in FIG. 2F.

The embodiment of the partially bonded seal 200 as depicted in FIG. 2F includes a total of four fluid conduits that are spaced evenly apart from each other around the distally facing surface of the second metal spike 206 at a spacing of ninety degrees (90°) radially. However, embodiments of the fluid conduits included in a partially bonded seal may include a smaller positive number or a larger positive number of fluid conduits other than four. In addition, in various embodiments the spacing between the fluid conduits is not limited to being evenly spaces apart radially around the distally facing surface of the second metal spike. In some embodiments, the fluid conduits may be arranged in groupings of two or more fluid conduits that are closer together to one another compared to other fluid conduits included in a different grouping of fluid conduits included in the second metal spike. The pressure conduits 260A-260D as illustrated in FIG. 2F are depicted as having a V-Shape in cross-section. However, the shape of any one of the fluid conduits is not limited to having a V-shape, and may be another shape, such as but not limited to square, may be square or flat bottomed, rounded bottom, elliptical, with slanted or straight and parallel side walls.

Figure 3A:
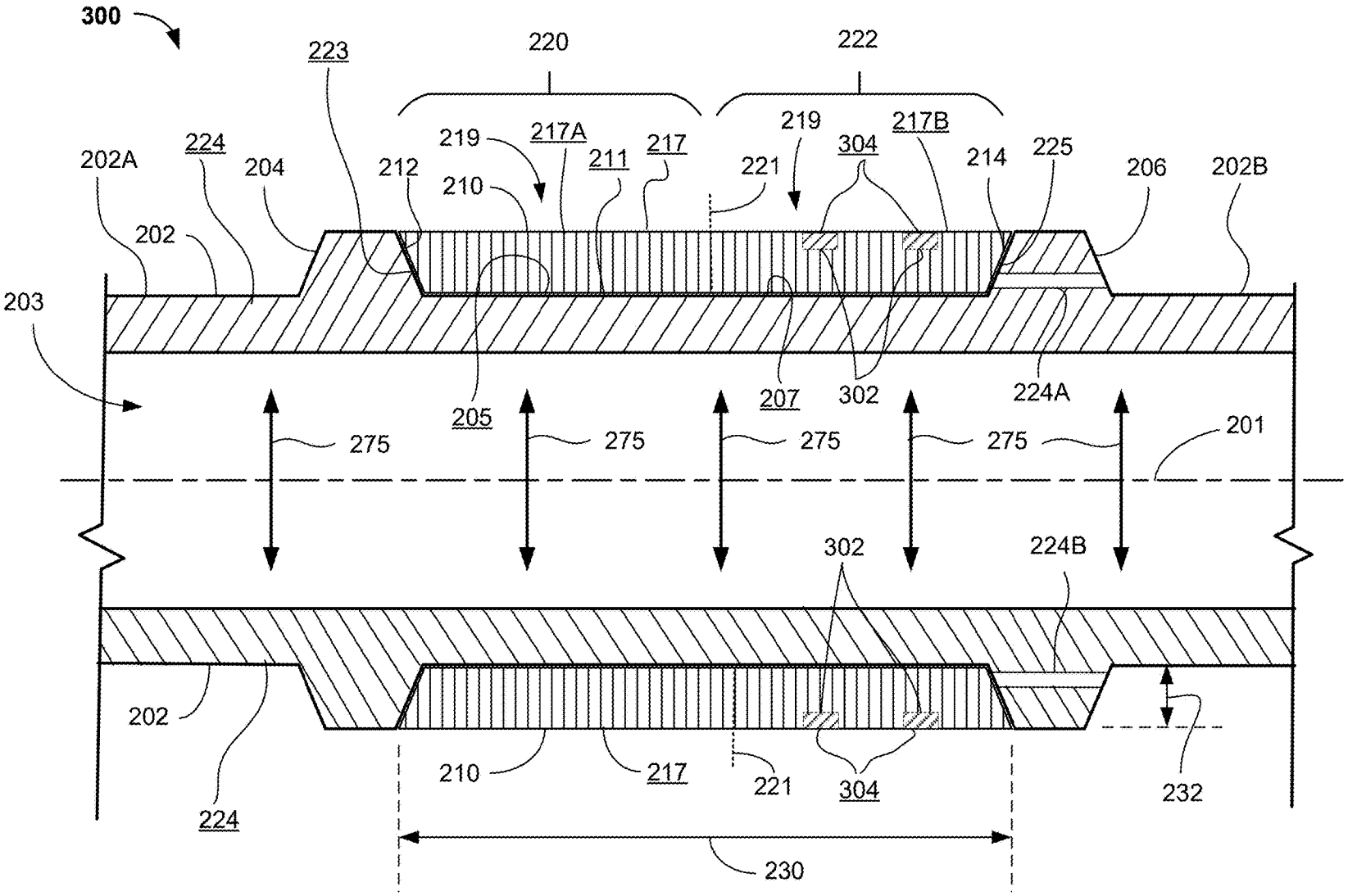
FIG. 3B illustrates a cutaway view of a partially bonded seal, in accordance with various embodiments.
FIGS. 3C-3E illustrate various views of bands that may be included as part of a sealing element, in accordance with various embodiments.

FIG. 3A illustrates a cutaway view of a partially bonded seal 300, in accordance with various embodiments. Embodiments of partially bonded seal 300 may include any of the features, and may be configured to perform any of the functions as ascribed above to partially bonded seal 200. However, for the sake of clarity and simplicity not every reference number utilized in FIGS. 2A-2F to describe partially bonded seal 200 are necessarily reproduced in FIG. 3A. Differences between partially bonded seal 200 of FIGS. 2A-2F and partially bonded seal 300 as shown in FIG. 3A are described below. Embodiments of partially bonded seal 300 may be utilized as the partially bonded seal included as partially bonded seal 132 in system 100, or any variation and/or equivalent thereof.

Referring to FIG. 3A, partially bonded seal 300 incorporates a pair of bands 302 as part of the sealing element 210. Bands 302 are positioned at the top surface 217B of the sealing element, and are spaced apart from one another within the non-bonded distal portion of the sealing element 210, generally indicated by bracket 222. Each of bands 302 encircles the longitudinal axis 201, in some embodiments forming a set of closed loops around the outer surface 224 of the hanger body, and are partially embedded within the sealing element 210 so that a top surface 304 of each of the bands is exposed outside of the sealing element. In various embodiments, the top surfaces 304 of each of the bands lies in a same cylindrically shaped surface as the top surface 217 of the sealing element 210. In various embodiments, one or more of bands 302 do not form a completely closed loop around the hanger body 202 even prior to the actuation of the partially bonded seal 300, for example as illustrated and described below with respect to FIG. 3C.

In various embodiments, each of bands 302 is formed from an expandable material, such as plastics, ductile metal sheet etc., which allows the bands to expand in a radial direction away from the longitudinal axis 201 when the partially bonded seal 300 is actuated in a manner illustratively represented by arrows 275 and as described above with respect to partially bonded seal 200. In such embodiments, bands 302 may remain intact in a closed loop configuration even after the actuation of sealing element 300 has been performed to expand the sealing element 210 for the purpose of forming a fluid seal between the hanger body 202 and another surface positioned adjacent to the partially bonded seal.

In various embodiments, each of bands 302 is formed so as to have a weakened or break away section. When the bands are expanded, as illustratively represented by arrows 275 in order to actuate the partially bonded seal, the bands are configured to break at the weakened or break away portion of each of the bands, (such as weakened section 307 in FIG. 3D, scored section 311 in FIG. 3E), which allows the bands to expand in a radial direction away from the longitudinal axis 201 when the partially bonded seal 300 is actuated in a manner illustratively represented by arrows 275 and as described above with respect to partially bonded seal 200. In such embodiments, bands 302 may remain embedded in an open or broken loop configuration after the actuation of sealing element 300 has been performed to expand the sealing element 210 for the purpose of forming a seal between the hanger body 202 and another surface positioned adjacent to the partially bonded seal. While illustrated in FIG. 3A as comprising two bands, embodiments of partially bonded seal 300 may include some other number of bands, such as a single band or a number of bands greater than two, such as but not limited to three or four band embodiments.

Figure 3B:
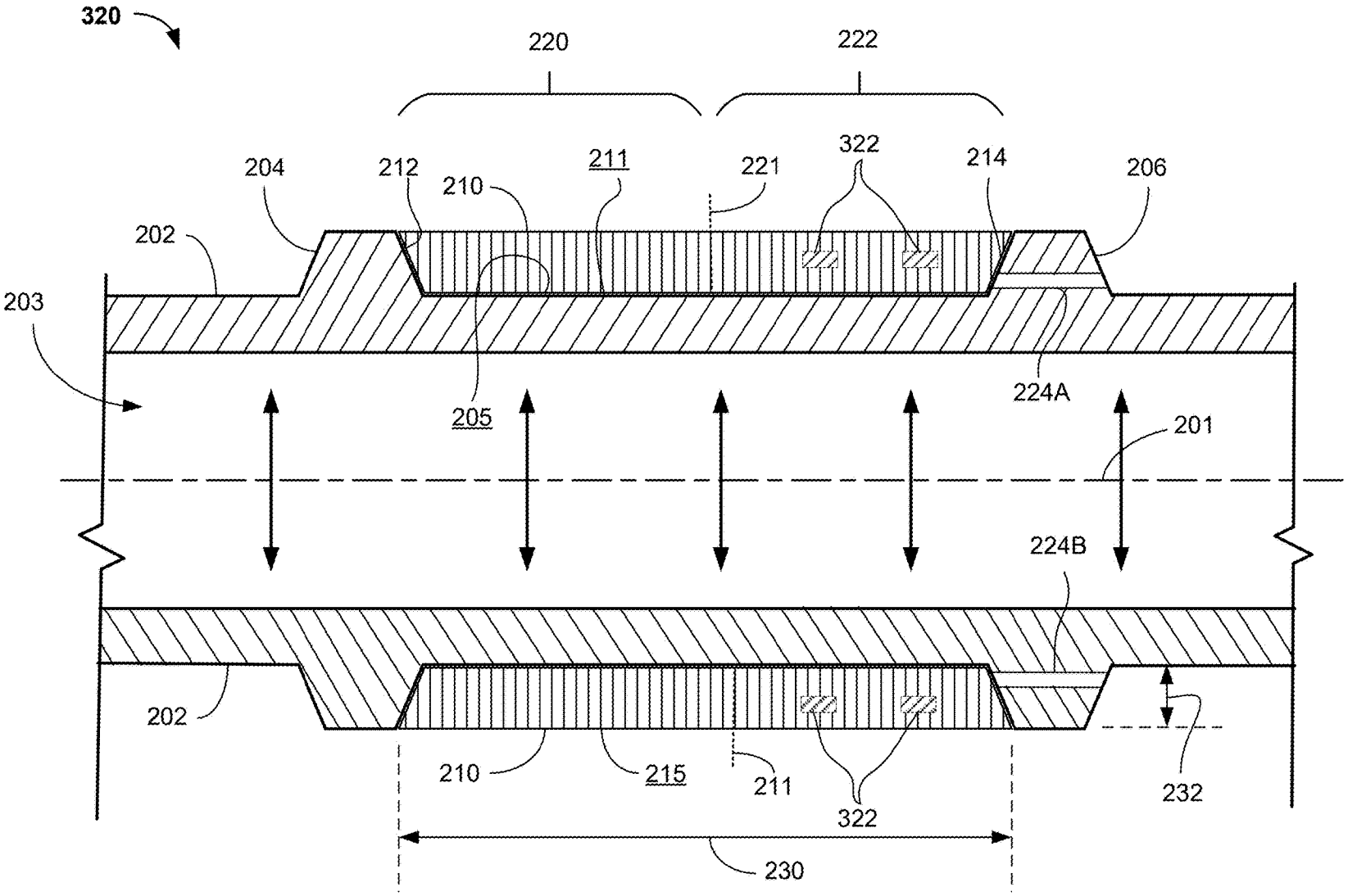

FIG. 3B shows a cutaway view of a partially bonded seal 320, in accordance with various embodiments. Embodiments of partially bonded seal 320 may include any of the features, and may be configured to perform any of the functions as ascribed above to partially bonded seal 200. However, for the sake of clarity and simplicity not every reference number utilized in FIGS. 2A-2F to describe partially bonded seal 200 are reproduced in FIG. 3B. Differences between partially bonded seal 200 of FIGS. 2A-2F and partially bonded seal 320 as shown in FIG. 3B are described below. Embodiments of partially bonded seal 320 may be utilized as the partially bonded seal included as partially bonded seal 132 in system 100, or any variation and/or equivalent thereof.

Referring to FIG. 3B, partially bonded seal 320 incorporates a pair of bands 322 as part of the sealing element 210. In contrast to bands 302 of partially bonded seal 300 (FIG. 3A), bands 322 as shown in FIG. 3B are completely embedded within sealing element 210, and are spaced apart from one another within the non-bonded portion of the sealing element 210 as generally indicated by bracket 222. None of the surfaces of bands 322 are exposed outside of the sealing element 210. In various embodiments, each of bands 322 encircles the longitudinal axis 201, forming a set of closed loops around hanger body 202 while remaining totally embedded within the sealing element 210. In various embodiments, one or more of bands 322 do not form a completely closed loop around the hanger body 202 even prior to the actuation of the partially bonded seal 320, for example as illustrated and described below with respect to FIG. 3C.

In various embodiments, each of bands 322 is formed from an expandable material, such as plastics, ductile metal sheet etc., which allows the bands to expand in a radial direction away from the longitudinal axis 201 when the partially bonded seal 320 is actuated in a manner illustratively represented by arrows 275 and as described above with respect to partially bonded seal 200. In such embodiments, bands 322 may remain intact in a closed loop configuration even after the actuation of sealing element 320 has been performed to expand the sealing element 210 for the purpose of forming a seal between the hanger body 202 and another surface positioned adjacent to the partially bonded seal.

In various embodiments, each of bands 322 is formed so as to have a weakened or break away section. When the bands are expanded, as illustratively represented by arrows 275 in order to actuate the partially bonded seal, the bands are configured to break at the weakened or break away portion of each of the bands, which allows the bands to expand in a radial direction away from the longitudinal axis 201 when the partially bonded seal 300 is actuated in a manner illustratively represented by arrows 275 and as described above with respect to partially bonded seal 320. In such embodiments, bands 322 may remain intact in a broken loop configuration and remain embedded within the sealing element even after the actuation of sealing element 320 has been performed to expand the sealing element 210 for the purpose of forming a seal between the hanger body 202 and another surface positioned adjacent to the partially bonded seal. While illustrated in FIG. 3B as comprising two bands, embodiments of partially bonded seal 320 may include some other number of bands, such as a single band or a number of bands greater than two, such as but not limited to three or four band embodiments.

Further, embodiments that include a combination of one or more bands having at least a top surface exposed and one or more bands that are completely embodied within the sealing element are contemplated for use in the sealing elements having bonded portions and non-bonded portions as described above. As illustrated in FIGS. 3A and 3B, bands 302 and 322 have a rectangular shape in cross-section at any point radially around the band. However, the bands 302 and 322 are not limited to having a rectangular cross-sectional shape, and may be other shapes in cross-section radially around the band, such as but not limited to a circular, elliptical, or triangular shape, and/or some other closed polygonal shape, such as star or diamond shaped.

Figure 3C:
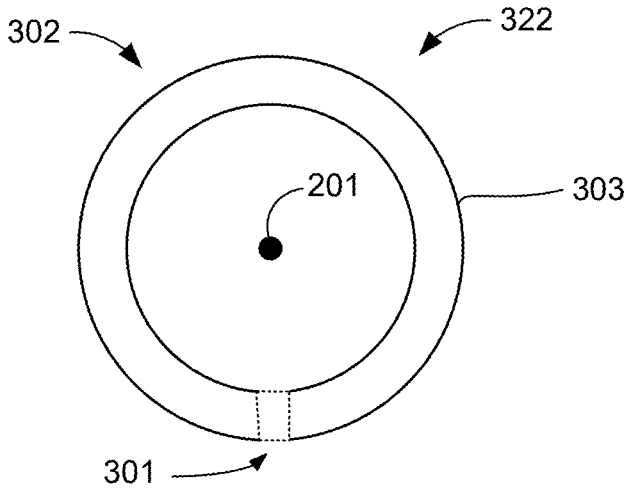
Figure 3D:
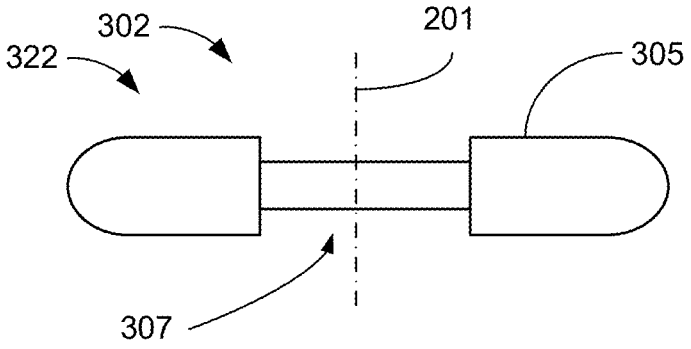
Figure 3E:
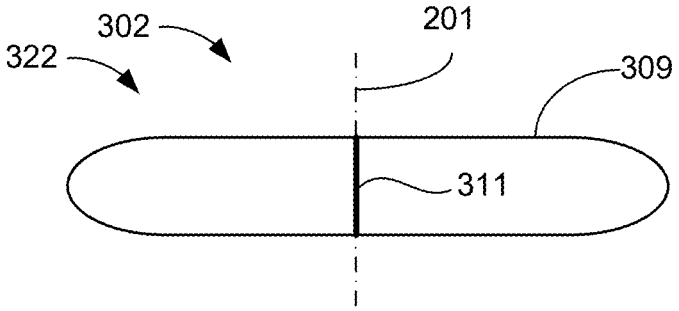

FIGS. 3C-3E illustrate various views of bands 302 and/or bands 322 that may be included as part of a sealing element, in accordance with various embodiments. FIG. 3C shows a side view of a band 303 that may be included in a sealing element, either as a partially embedded or a fully embedded band. As shown in FIG. 3C, embodiments of band 303 may form a continuous ring completely encircling the longitudinal axis 201. For bands 303 having a continuous ring shape, the band may be formed from a material, such as plastics, ductile metal sheet etc., that allows the diameter of the band to be expanded when the sealing element in which the band is located is actuated. In alternative embodiments, band 303 includes a break 301 in the body of the band, which is configured to allow the band to expand outward radially away from the longitudinal axis 201 when the sealing element in which the band is located is actuated.

FIG. 3D shows a top view of a band 305 that may be included in a sealing element, either as a partially embedded or a fully embedded band. Embodiments of band 305 may include a continuous ring completely encircling the longitudinal axis 201, but incorporating a weakened section 307, which may be formed by reducing one or more dimensions, such as a thickness dimension of the body of the band 305 relative to the one or more dimensions of the remainder of the band. The weakened section is configured to break apart and create an opening in the shape of the band, thereby allowing the band 305 to expand outward radially away from the longitudinal axis 201 when the sealing element in which the band is located is actuated. Band 305 may be made from plastics, ductile metal sheet etc., or any of the materials described above with respect to band 303.

FIG. 3E shows a top view of a band 309 that may be included in a sealing element, either as a partially embedded or a fully embedded band. Embodiments of band 309 may form a continuous ring completely encircling the longitudinal axis 201, but incorporate a weakened section 311 in the form of a score or grooved area that incurs into the body of the band. The scored or grooved area of the band 309 is configured to break apart and create an opening in the shape of the band, thereby allowing the band 309 to expand outward radially away from the longitudinal axis 201 when the sealing element in which the band is located is actuated. Band 309 may be made from plastics, ductile metal sheet etc., or any of the materials described above with respect to band 303.

For embodiments of the partially bonded seals using bands 302 or 322, the sealing element may be made from a thermoplastic or an elastomeric material, along with some optional breakable bands to better control the flare-up action of the unbonded sealing element during run-in if needed. The breakable band is a circumferentially continuous band that breaks during the expansion without creating defect in seal material. The break-up mechanism can be guided by choice of material and the required rupture strain and/or with addition of some weak links around the circumference to promote and guide the break-up points. The breakable bands can be either externally positioned to have their top surfaces flushed with the top surface of the sealing element, or they can be internally embedded within the rubber material. The location, depth, and number of the bands can be determined by detailed analysis. The breakable bands can be alternatively replaced with expandable bands with tuned circumferential stiffness to allow radial enlargement during the expansion but not during run-in. The expandable band may or may not be circumferentially continuous. For any embodiments of the partially bonded seal that include bands, the bands may function to better control the flare-up action of the unbonded sealing element during run-in of the liner as the liner is being positioned within the wellbore while not inhibiting the sealing function of the partially bonded seal after actuation of the partially bonded seal used to form a fluid seal between the hanger body incorporating the partially bonded seal and another conduit.

Figure 4A:
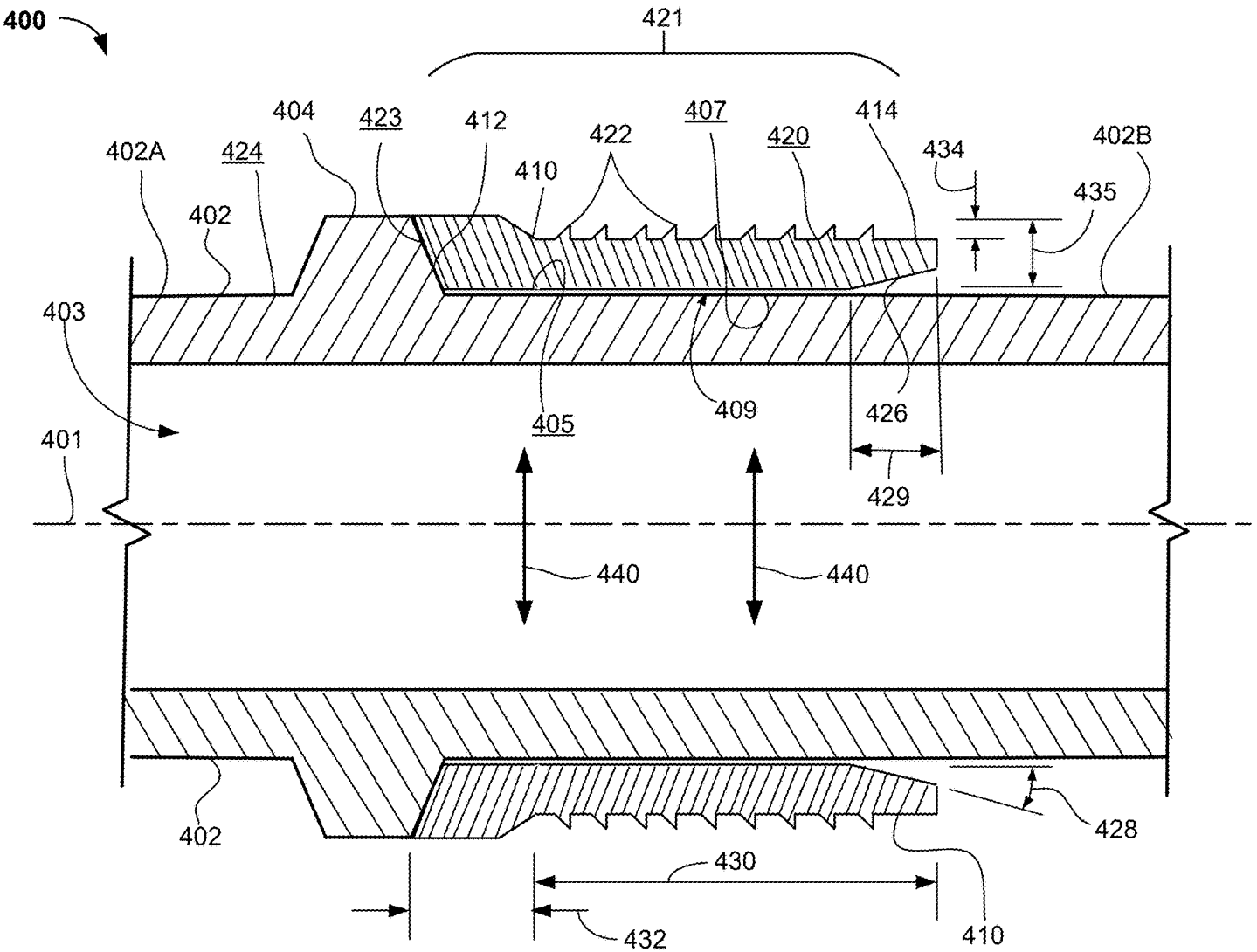
FIG. 4A illustrates a cutaway view of a partially bonded seal for providing a pressure seal within a wellbore system, in accordance with various embodiments.

FIG. 4A illustrates a cutaway view of partially bonded seal 400 for providing a pressure seal within a wellbore system, in accordance with various embodiments. Partially bonded seal 400 may be an embodiment of partially bonded seal 132 as illustrated and described above with respect to FIG. 1A and may be configured to be actuated using a seal actuation tool in a same or similar manner as described above with respect to partially bonded seal 200 in FIG. 1B.

Referring to FIG. 4A, features of the partially bonded seal 400 may include an adaptive seal comprising a metal sleeve 410 positioned around the outer surface 424 of hanger body 402 configured to provide a fluid seal between a liner coupled to the hanger body 402 and a surface of another conduit (not specifically shown in FIG. 4A), such as a casing or another liner. Hanger body 402 forms a passageway 403 that extends through the length of the partially bonded seal 400 along longitudinal axis 401. Metal sleeve 410 includes a set of teeth 422 projecting away from a top surface 420 of the metal sleeve. In various embodiments, metal sleeve 410 encircles the longitudinal axis 401 of the partially bonded seal 400, and encircles an outer surface 424 of the hanger body 402 for a longitudinal dimension 430 along the longitudinal axis 401. Each of the teeth of the set of teeth 422 also encircle the top surface of the 420 of the metal sleeve 410 at spaced intervals longitudinally along the metal sleeve. Hanger body 402 includes a metal spike 404 positioned along the outer surface 424 of the hanger body and located adjacent to the proximal end 402A of hanger body 402, and proximally of the metal sleeve 410. In various embodiments, metal spike 404 encircles entirely the longitudinal axis 401 and the hanger body 402 for at least some portion of the hanger body longitudinally.

In various embodiments, only a portion of the metal sleeve 410 is bonded to any part of the outer surface 424 of the hanger body 402. For example, in some embodiments only a proximal end 412 of metal sleeve 410 is bonded to a distally facing surface 423 of metal spike 404. As shown in FIG. 4A, a bottom surface 405 of the metal sleeve 410 is adjacent to the outer surface 424 over a distance longitudinally generally indicated by bracket 421, but is not bonded to the outer surface 424, and may be spaced away from the outer surface 424 in order to provide a gap 409 between the bottom surface 405 of the metal sleeve and the outer surface 424 of the hanger body 402. Gap 409 in various embodiments is coupled to be in fluid communication with fluid pressure that may be present at the distal end 414 of the metal sleeve 410. As further described below, the fluid pressure present at the distal end 414 may be communicated into gap 409, and provide a further upward force on the unbonded portion of the metal sleeve which thereby provides additional sealing force between the teeth 422 of the metal sleeve 410 and another surface, such as an inner surface of a casing or another liner (not shown in FIG. 4A), between which the partially bonded seal 400 is providing a fluid seal between the hanger body and the surface of the other conduit.

In various embodiments, the bottom surface 405 includes a ramp 426 that extends away from the bottom surface 405 in a direction away from the outer surface 424 at an angle 428 over a distance 429 and ending at the distal end 414 of the metal sleeve. The ramp 426 provides a passageway for fluid pressure present at the distal end 414 of the metal sleeve 410 to be communicated into gap 409 in order to further increase the sealing force being applied by the metal sleeve 410 to an adjacent surface on another device, such as a casing or another liner, while the bonded portion of the metal sleeve, and in some embodiments the proximal end 412, remains bonded to the hanger body 402 at the distally facing surface 423 of metal spike 404 in order to maintain the position of the metal sleeve relative to the hanger body after actuation of the partially bonded seal 400 and during times when fluid pressure is present at that distal end 414 of the metal sleeve. When fluid pressure is received at gap 409, the radially outward deformation of the unbonded portion of the metal sleeve 410 caused by the fluid pressure compensates for the radially inward deformation of the seal carrier, for instance the hanger body 402, resulting in the ability of the partially bonded seal to maintain the required seal contact stress and seal robustness.

In various embodiments, actuation of the partially bonded seal 400 may include deforming the hanger body 402 in a manner that moves the top surface 420 of the partially bonded seal 400 in a direction that is further away radially from longitudinal axis 401, and thus extends the top surface 420 of the metal sleeve 410 in a direction that is farther away radially from the longitudinal axis 401. This expansion of the hanger body can be used to bring at least some portions of the top surface 420 of the metal sleeve 410 into physical contact with a surface of another element, such as a casing of a wellbore, and thereby form a fluid seal between the hanger body 402 and the element that has been brought into contact with the outer surface of the sealing element.

In various embodiments, unlike helical threads, each tooth in the set of teeth 422 is formed as an individual closed circle around the circumference of the top surface 420 of the metal sleeve. The proximal end 412 of the metal sleeve is joined to the last spike of the hanger, i.e., metal spike 404, and wherein there is no additional metal spike included distally of the metal sleeve going longitudinally toward the distal end 402B of the hanger body as part of the partially bonded seal 400. There is a small assembly-required tolerance gap 409 between the bottom surface 407 of the metal sleeve and the outer surface 424 of the of the hanger body 402. Because upon actuation of the partially bonded seal 400 gap 409 may be closed off, the bottom surface 405 of the metal sleeve 410 may include a set of longitudinal or spiral grooves configured to allow fluid penetration beneath the bottom surface 405 of the metal sleeve, thus providing addition radially outward forces, as illustratively represented by arrows 440, to increase the sealing force between the top surface 420 and the set of teeth 422 of the metal sleeve relative to the surface of the casing or other liner where partially bonded seal 400 is being deployed.

When partially bonded seal 400 is actuated to expand the hanger body 402, the metal sleeve 410 expands plastically and bites to the casing or the other liner positioned adjacent to the metal sleeve. Once the expansion cone of the seal expansion tool used to actuate the partially bonded seal 400 is removed from passageway 403, the fluid seal between the hanger body 402 and the casing or other hanger is maintained as the expansion of the metal sleeve 410 is mainly a plastic (permanent) deformation and the share of the elastic (recoverable) deformation is negligible. Following actuation of the partially bonded seal 400 and fluid pressure is applied to the distal end 414 of the metal sleeve 410, the fluid seal is further forced radially outward as it is in the plastic states with much smaller stiffness compared to the elastic state, thus compensating for the radially inward deformation of the hanger.

Figure 4B:
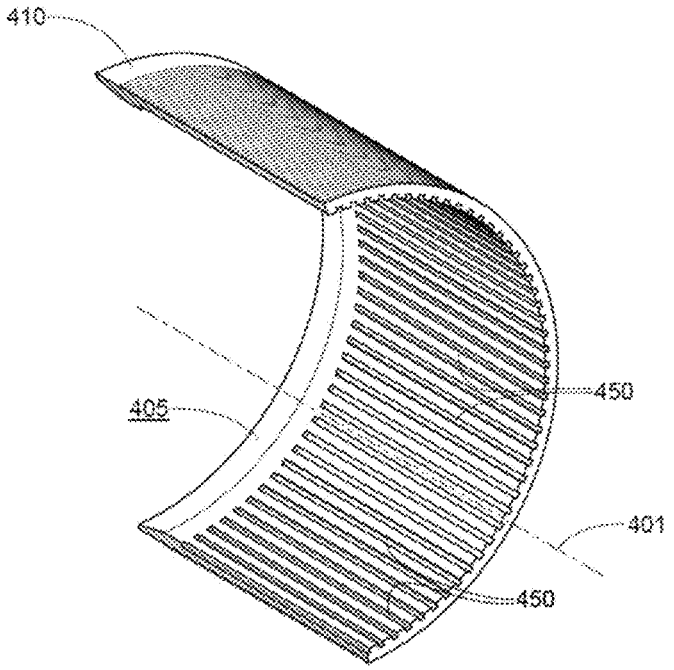
FIGS. 4B-4C illustrate cutaway perspective views of the embodiments of fluid passageways formed on the bottom surface of a metal sleeve, in accordance with various embodiments.
Figure 4C:
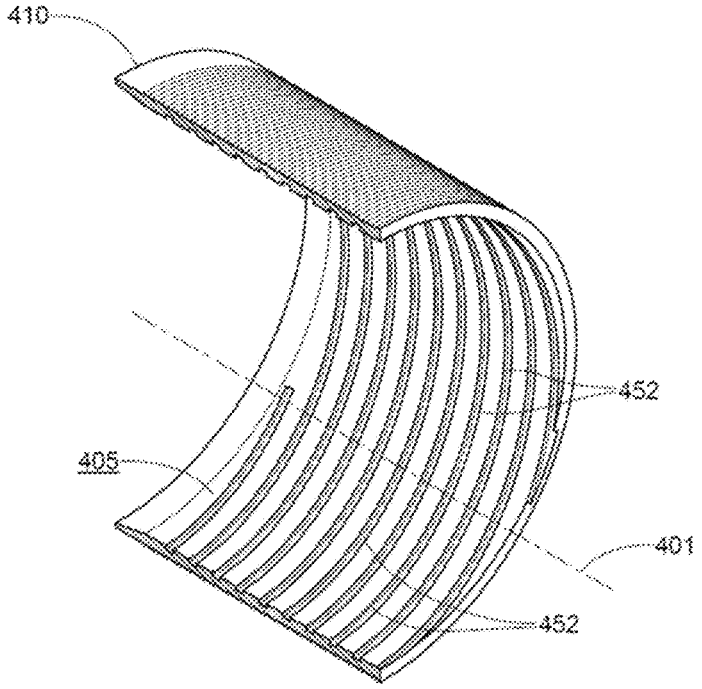

FIGS. 4B-4C illustrate cutaway perspective view of the embodiments of fluid passageways formed on the bottom surface 405 of metal sleeve 410, in accordance with various embodiments. FIG. 4B illustrates a cutaway perspective view of the bottom surface 405 of metal sleeve 410 having a plurality of longitudinal grooves 450. Each of the longitudinal grooves 450 is oriented in a line that is parallel to and radially spaced away from longitudinal axis 401. Longitudinal grooves 450 are configured to allow fluid pressure to be exerted on bottom surface 405 of the metal sleeve even when the metal sleeve is actuated and gap 409 is closed down so that areas outside of the grooves are in contact with the hanger body 402.

FIG. 4C illustrates a cutaway perspective view of the bottom surface 405 of metal sleeve 410 having a plurality of grooves formed as helical grooves 452. The helical grooves 452 are connected in a continuous manner, and may be oriented in a non-parallel direction that encircles the longitudinal axis 401. The helical grooves 452 are configured to allow fluid pressure to be exerted on bottom surface 405 of the metal sleeve even when the metal sleeve is actuated and gap 409 is closed down so that areas outside of the grooves are in contact with the hanger body 402.

Figure 5:
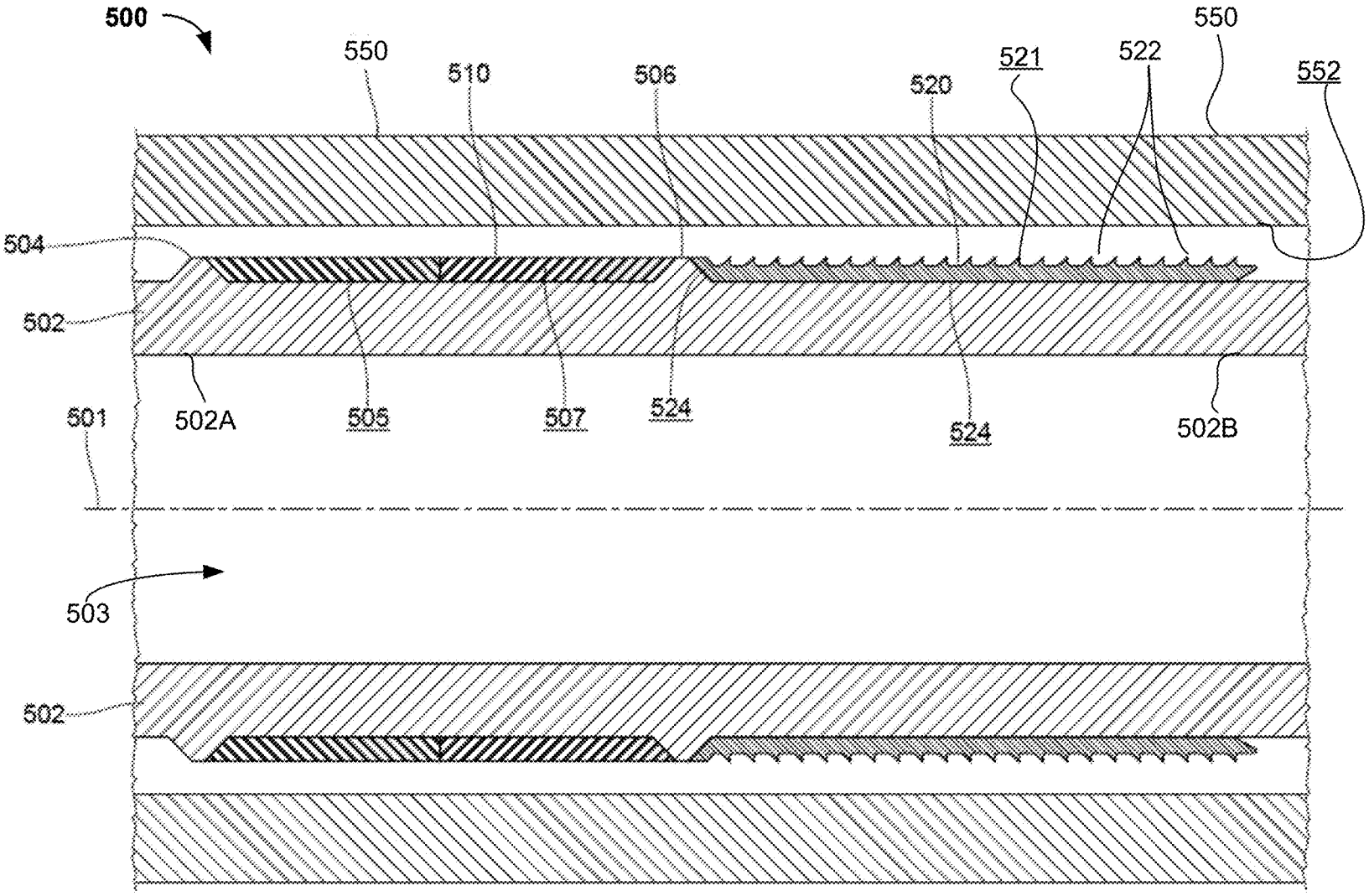
FIG. 5 illustrates a cutaway view of a combination sealing element and metal sleeve, in accordance with various embodiments.

FIG. 5 illustrates a cutaway view of a partially bonded seal 500, in accordance with various embodiments. As shown in FIG. 5, partially bonded seal 500 includes a hanger body 502 encircling a longitudinal axis 501. Hanger body 502 including a first metal spike 504 extending from the outer surface 524 of the hanger body, near the proximal end 502A of the partially bonded seal 500, and a second metal spike 506 extending from the outer surface 524 near a mid-point of the partially bonded seal. A first sealing element 510 including a first bottom surface 505 that is bonded to the outer surface 524 and a second bottom surface 507 that is not bonded to the outer surface 524 extends longitudinally between the first metal spike 504 and the second metal spike 506. In addition to sealing element 510, a second sealing element comprising metal sleeve 520, and having a set of teeth 522 extending from upper surface 521 of the metal sleeve, extents longitudinally along the outer surface 524 in a distal direction toward the distal end 502B of the partially bonded seal. A casing 550 encircles the hanger body 502 and partially bonded seal 500, wherein the sealing element 510 and metal sleeve 520 are configured to be actuated by expanding the hanger body 502 outward radially so that top surfaces of the sealing element 510 and the metal sleeve 520 form a fluid seal between the top surfaces of each of these sealing elements and an inner surface 552 of the casing.

Figure 6:
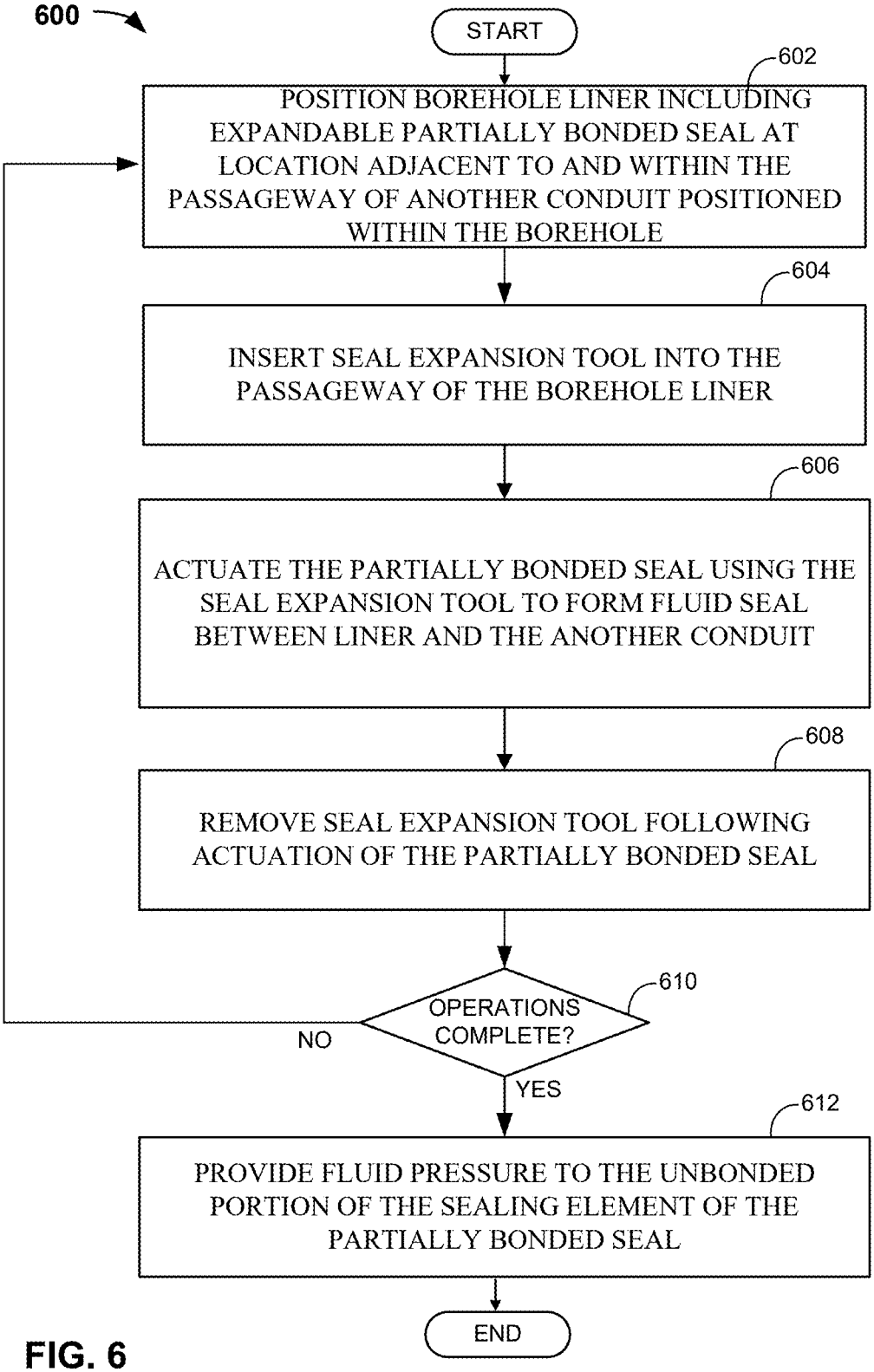
FIG. 6 illustrates a flowchart of one or more methods, in accordance with various embodiments.

FIG. 6 illustrates a flowchart of one or more methods 600, in accordance with various embodiments. Embodiments of method 600 may be performed by a computer system, such as computer system 150 as illustrated and described above with respect to FIG. 1.

In various embodiments, method 600 includes positioning a borehole liner, including an expandable partially bonded seal, at a location adjacent to and within the conduit passageway of another conduit positioned within a borehole, (block 602). Embodiments of the partially bonded seal include a hanger body and a sealing element, the sealing element positioned in contact with and encircling an outer surface of the hanger body for some longitudinal distance along the hanger body, wherein a bottom surface of a first portion of the sealing element is bonded to the outer surface of the hanger body, and wherein a bottom surface of a second portion of the sealing element is not bonded to the outer surface of the hanger body. The second portion of the sealing element may be in physical contact with the outer surface of the hanger body, at least along a portion of the second portion, and/or may be positioned adjacent to the outer surface of the hanger body. In various embodiments, the sealing element extends within a recess formed between a first metal spike and a second metal spike, each of the metal spikes extending away from the outer surface of the hanger body, and having a first portion of the bottom surface of the sealing element bonded to the outer surface of the hanger body while a second portion of the bottom surface of the sealing element in not bonded to but may be in physical contact with the outer surface of the hanger body when the partially bonded seal is in an unactuated configuration, for example as shown in FIG. 1B.

Embodiments of the partially bonded seal may include pressure penetration passageways as illustrated and described above with respect to FIG. 2A. Embodiments of the partially bonded seal may include pressure conduits as illustrated and described above with respect to FIG. 2C. Embodiments of the partially bonded seal may include internal passageways that extend within a portion of the sealing element as illustrated and described above with respect to FIG. 2D. Embodiments of the partially bonded seal may incorporate one or more expandable and/or breakable bands that may be partially or fully embedded within the sealing element, as illustrated above with respect to FIGS. 3A and 3B. Embodiments of the partially bonded seal may include a metal sleeve configured as the sealing element, as illustrated and described above with respect to FIGS. 4A-4C and FIG. 5.

In various embodiments, method 600 includes inserting a seal expansion tool into the liner passageway extending through and encircled by the expandable partially bonded seal, (block 604). Embodiments of the seal expansion tool include the seal expansion tool 170 as illustrated and described above with respect to FIG. 1B, and/or any equivalent thereof.

In various embodiments, method 600 includes actuating the partially bonded seal using the seal expansion tool to form a fluid seal between the liner hanger that includes the partially bonded seal and another conduit (block 606). In various embodiments, actuating the partially bonded seal includes advancing the seal expansion tool in a distal direction through the passageway that is encircled by the partially bonded seal and the liner hanger in order to permanently deform a reduced diameter section of the hanger body in a radially outward direction and thereby bring a top surface of the sealing element into sealing contact with a surface, such as an inner surface, of the another conduit In various embodiments, the seal expansion tool includes a cone or one or more forcing elements that engage an inner surface of the hanger body as the seal expansion tool is advanced distally through the reduced diameter section of the seal assembly in order to deform the reduced diameter section of the hanger body in the radially outward direction and bring the top surface of the sealing element into contact with the surface of the conduit placed adjacent to the sealing element during the actuation process. In various embodiments, actuation of the partially bonded seal may include expansion of and/or breaking of one or more bands, one or more of which may be partially and/or fully embedded within the sealing element, for example as illustrated and describe above with respect to FIGS. 3A-3B.

In various embodiments, method 600 includes removing the seal expansion tool from the passageway of the liner hanger following completion of the actuation of the expandable portion of the liner hanger and the partially bonded seal (block 608).

In various embodiments, method 600 includes determining if the lining operation of the wellbore is complete (block 610). In various embodiments, if the is not complete (the "NO branch exiting decision block 610), embodiment of method 600 return to block 602, where additional liner(s) may be positioned within the wellbore and actuated to provide fluid seals within the wellbore to existing conduits already positioned within the wellbore. If a determination is made that the lining operations are completed, (the "YES" branch exiting decision block 610), embodiments of method 600 may proceed to block 612. Embodiments of method 600 may include performing one or more wellbore operations, such as but not limited to further drilling operations, well treatment operations such as cleaning and/or fracturing operations, core sampling and/or other logging operations, between the installation of individual liners within the wellbore.

In various embodiments, method 600 includes providing fluid pressure to the unbonded portion of the sealing element of a partially bonded seal following actuation of the partially bonded seal so that the sealing element of the partially bonded seal is forming a fluid seal between the liner hanger that includes the partially bonded seal and another conduit (block 612). In various embodiments fluid pressure is provided to the unbonded portion of the sealing element through one or more fluid passageways and/or fluid conduits extending through and/or over the metal spike positioned along the hanger body and distal to the sealing element, as illustrated and describe above for example with respect to FIGS. 2A-2F, FIGS. 3A-3B and FIG. 5, and/or with respect to the metal sleeve acting as the partially bonded sealing element, for example with respect to FIG. 4A and FIG. 5.

It will be understood that one or more blocks of the flowchart illustrations and/or block diagrams, and combinations of blocks in the flowchart illustrations and/or block diagrams, can be implemented by program code. The program code may be provided to a processor of a general-purpose computer, special purpose computer, or other programmable machine or apparatus, which may be included but are not limited to devices included in computer system 150 (FIG. 1A). As will be appreciated, aspects of the disclosure may be embodied as a system, method or program code/instructions stored in one or more non-transitory machine-readable media. Accordingly, aspects may take the form of hardware, software (including firmware, resident software, micro-code, etc.), or a combination of software and hardware aspects that may all generally be referred to herein as a "circuit," "module" or "system." The functionality presented as individual modules/units in the example illustrations can be organized differently in accordance with any one of platform (operating system and/or hardware), application ecosystem, interfaces, programmer preferences, programming language, administrator preferences, etc.

Computer program code for carrying out operations for aspects of the disclosure may be written in any combination of one or more programming languages, including an object oriented programming language such as the Java® programming language, C++ or the like; a dynamic programming language such as Python; a scripting language such as Perl programming language or PowerShell script language; and conventional procedural programming languages, such as the "C" programming language or similar programming languages. The program code may execute entirely on a stand-alone machine, may execute in a distributed manner across multiple machines, and may execute on one machine while providing results and or accepting input on another machine. While depicted as a computer system 150 or as a general purpose computer, some embodiments can be any type of device or apparatus to perform operations described herein.

As will be appreciated, aspects of the disclosure may be embodied as a system, method or program code/instructions stored in one or more non-transitory machine-readable media. Accordingly, aspects may take the form of hardware, software (including firmware, resident software, micro-code, etc.), or a combination of software and hardware aspects that may all generally be referred to herein as a "circuit," "module" or "system." The functionality presented as individual modules/units in the example illustrations can be organized differently in accordance with any one of platform (operating system and/or hardware), application ecosystem, interfaces, programmer preferences, programming language, administrator preferences, etc.

Any combination of one or more machine readable medium(s) may be utilized. The machine readable medium may be a machine readable signal medium or a machine readable storage medium. A machine readable storage medium may be, for example, but not limited to, a system, apparatus, or device, which employs any one of or combination of electronic, magnetic, optical, electromagnetic, infrared, or semiconductor technology to store program code. More specific examples (a non-exhaustive list) of the machine readable storage medium would include the following: a portable computer diskette, a hard disk, a random access memory (RAM), a read-only memory (ROM), an erasable programmable read-only memory (EPROM or Flash memory), a portable compact disc read-only memory (CD-ROM), an optical storage device, a magnetic storage device, or any suitable combination of the foregoing. In the context of this document, a machine readable storage medium may be any tangible medium that can contain, or store a program for use by or in connection with an instruction execution system, apparatus, or device. A machine readable storage medium is not a machine readable signal medium.

While the aspects of the disclosure are described with reference to various implementations and exploitations, it will be understood that these aspects are illustrative and that the scope of the claims is not limited to them. In general, techniques for providing and actuating partially bonded seals in a wellbore as described herein may be implemented with facilities consistent with any hardware system or hardware/software systems. Many variations, modifications, additions, and improvements are possible.

Plural instances may be provided for components, operations or structures described herein as a single instance. Finally, boundaries between various components, operations and data stores are somewhat arbitrary, and particular operations are illustrated in the context of specific illustrative configurations. Other allocations of functionality are envisioned and may fall within the scope of the disclosure. In general, structures and functionality presented as separate components in the example configurations may be implemented as a combined structure or component. Similarly, structures and functionality presented as a single component may be implemented as separate components. These and other variations, modifications, additions, and improvements may fall within the scope of the disclosure.

Use of the phrase "at least one of" preceding a list with the conjunction "and" should not be treated as an exclusive list and should not be construed as a list of categories with one item from each category, unless specifically stated otherwise. A clause that recites "at least one of A, B, and C" can be infringed with only one of the listed items, multiple of the listed items, and one or more of the items in the list and another item not listed.

EXAMPLE EMBODIMENTS

Non-limiting example embodiments include the following:

Embodiment 1, An apparatus comprising: a partially bonded seal configured to be actuatable to provide a fluid seal between a first conduit and a second conduit positioned within a wellbore, the partially bonded seal comprising a hanger body and a sealing element, the sealing element positioned in contact with and encircling an outer surface of the hanger body for some longitudinal distance along the hanger body, wherein a first portion of the sealing element that is adjacent to the outer surface of the hanger body is bonded to the outer surface of the hanger body, and wherein a second portion of the sealing element that is adjacent to the outer surface of the hanger body is not bonded to the outer surface of the hanger body.

Embodiment 2. The apparatus of embodiment 1, wherein the sealing element is bonded at a proximal end of the sealing element to a first metal spike that extends radially outward and encircles the outer surface of the hanger body, and wherein the sealing element extends along the outer surface of the hanger body to a distal end of the sealing element which is not bonded to but is positioned adjacent to a proximally facing surface of a second metal spike that extends radially outward and encircles the outer surface of the hanger body at a longitudinal distance away from the first metal spike.

Embodiment 3. The apparatus of embodiment 2, wherein the second metal spike comprises one or more fluid passageways configured to provide communication of fluid pressure present at a distal face of the second metal spike to the second portion of the sealing element that is not bonded to the outer surface of the hanger body in order to apply an additional sealing force in a radially outward direction to the second portion of the sealing element.

Embodiment 4. The apparatus of any one of embodiments 1-3, wherein the first conduit is a wellbore casing and the second conduit is a wellbore liner configured to attach to a distal end of the casing, and wherein the sealing element is configured to provide the fluid seal between an inner surface of the wellbore casing and the outer surface of the hanger body.

Embodiment 5. The apparatus of any one of embodiments 1-4, wherein the sealing element comprises an elastomeric material or a thermoplastic material.

Embodiment 6. The apparatus of any one of embodiments 1-5, wherein the sealing element comprises a plurality of expandable or breakable bands that are at least partially embedded within the sealing element, and wherein each of the expandable or breakable bands encircles the outer surface of the hanger body.

Embodiment 7. The apparatus of embodiment 6, wherein one or more of the plurality of expandable or breakable bands are completely embedded within the sealing element.

Embodiment 8. The apparatus of any one of embodiments 1-4, wherein the sealing element comprises a metal sleeve that encircles the outer surface of the hanger body, and wherein the metal sleeve includes a plurality of ring shaped teeth that encircle the outer surface of the metal sleeve and are configured to engage a surface of a casing positioned adjacent to the metal sleeve when the partially bonded seal is actuated.

Embodiment 9. The apparatus of any one of embodiments 1-4, wherein the sealing element include a fluid passageway that extends from a distal end of the sealing element into one or more internal passageways that are completely within to the sealing element, the one or more internal passageways configured to apply a force on the second portion of the sealing element in a radially outward direction and away from the hanger body when fluid pressure is present at the fluid passageway.

Embodiment 10. A system comprising: a partially bonded seal configured to be actuatable to provide a fluid seal between a first conduit and a second conduit positioned within a wellbore, the partially bonded seal comprising a hanger body and a sealing element, the sealing element positioned in contact with and encircling an outer surface of the hanger body for some longitudinal distance along the hanger body, wherein a first portion of the sealing element is adjacent to and is bonded to the outer surface of the hanger body, and wherein a second portion of the sealing element is adjacent to and is not bonded to the outer surface of the hanger body; and a seal expansion tool configured to be inserted into a liner passageway extending through and encircled by the hanger body and moved in a longitudinal direction through the liner passageway in order to radially expand a reduced diameter portion of the hanger body that includes the sealing element and thereby bring one or more surfaces of the sealing element into contact with a surface of the second conduit in order to form the fluid seal between the first conduit and the second conduit.

Embodiment 11. The system of embodiment 10, wherein the sealing element is bonded at a proximal end of the sealing element to a first metal spike that extends radially outward and encircles the outer surface of the hanger body, and wherein the sealing element extends along the outer surface of the hanger body to a distal end of the sealing element which is not bonded to but is positioned adjacent to a proximally facing surface of a second metal spike that extends radially outward and encircles the outer surface of the hanger body at a longitudinal distance away from the first metal spike.

Embodiment 12. The system of embodiments 10 or 11, wherein the sealing element comprises an elastomeric material or a thermoplastic material.

Embodiment 13. The system of any one of embodiments 10-12, wherein the sealing element comprises a plurality of expandable or breakable bands that are at least partially embedded within the sealing element, and wherein each of the expandable or breakable bands encircles the outer surface of the hanger body.

Embodiment 14. The system of embodiment 13, wherein one or more of the plurality of expandable or breakable bands are completely embedded within the sealing element.

Embodiment 15. The system of embodiments 10 or 11, wherein the sealing element comprises a metal sleeve that encircles the outer surface of the hanger body, and wherein the metal sleeve includes a plurality of ring shaped teeth that encircle the outer surface of the metal sleeve and are configured to engage a surface of a casing positioned adjacent to the metal sleeve when the partially bonded seal is actuated.

Embodiment 16. A method comprising: positioning a wellbore liner including an expandable partially bonded seal adjacent to and within a conduit passageway of a conduit positioned with a wellbore, the expandable partially bonded seal comprising a hanger body and a sealing element, the sealing element positioned in contact with and encircling an outer surface of the hanger body for some longitudinal distance along the hanger body, wherein a first portion of the sealing element is adjacent to and is bonded to the outer surface of the hanger body, and wherein a second portion of the sealing element is adjacent to and is not bonded to the outer surface of the hanger body; inserting a seal expansion tool into a liner passageway extending through and encircled by the expandable partially bonded seal; and actuating the expandable partially bonded seal using the seal expansion tool to expand the hanger body and bring one or more surfaces of the sealing element into contact with a surface of the conduit in order to form a fluid seal between the wellbore liner and the conduit.

Embodiment 17. The method of embodiment 16, wherein the sealing element comprises an elastomeric material or a thermoplastic material.

Embodiment 18. The method of embodiments 16 or 17, wherein the sealing element comprises a plurality of expandable or breakable bands that are at least partially embedded within the sealing element, and wherein each of the expandable or breakable bands encircles the outer surface of the hanger body.

Embodiment 19. The method of embodiment 18, wherein one or more of the plurality of expandable or breakable bands are completely embedded within the sealing element.

Embodiment 20. The method of embodiment 16, wherein the sealing element comprises a metal sleeve that encircles the outer surface of the hanger body, and wherein the metal sleeve includes a plurality of ring shaped teeth that encircle the outer surface of the metal sleeve and are configured to engage a surface of a casing positioned adjacent to the metal sleeve when the expandable partially bonded seal is actuated.

What is claimed is:

1. An apparatus comprising:

a partially bonded seal configured to be actuatable to provide a fluid seal between a first conduit and a second conduit positioned within a wellbore, the partially bonded seal comprising a hanger body and a sealing element, the sealing element positioned in contact with and encircling an outer surface of the hanger body for some longitudinal distance along the hanger body, wherein the sealing element comprises a sleeve including a plurality of ring shaped teeth that encircle the outer surface of the hanger body, the teeth configured to engage a surface of the first conduit positioned adjacent to the sleeve when the partially bonded seal is activated, wherein a first portion of the sealing element that is adjacent to the outer surface of the hanger body is bonded to the outer surface of the hanger body, and wherein a second portion of the sealing element that is adjacent to the outer surface of the hanger body that is not bonded to the outer surface of the hanger body.

2. The apparatus of claim 1, wherein the sealing element is bonded at a proximal end of the sealing element to a first metal spike that extends radially outward and encircles the outer surface of the hanger body, and wherein the sealing element extends along the outer surface of the hanger body to a distal end of the sealing element which is not bonded to but is positioned adjacent to a proximally facing surface of a second metal spike that extends radially outward and encircles the outer surface of the hanger body at a longitudinal distance away from the first metal spike.

3. The apparatus of claim 2, wherein the second metal spike comprises one or more fluid passageways configured to provide communication of fluid pressure present at a distal face of the second metal spike to the second portion of the sealing element that is not bonded to the outer surface of the hanger body in order to apply an additional sealing force in a radially outward direction to the second portion of the sealing element.

4. The apparatus of claim 1, wherein the first conduit is a wellbore casing and the second conduit is a wellbore liner configured to attach to a distal end of the casing, and wherein the sealing element is configured to provide the fluid seal between an inner surface of the wellbore casing and the outer surface of the hanger body.

5. The apparatus of claim 1, wherein the sealing element comprises an elastomeric material or a thermoplastic material.

6. The apparatus of claim 1, wherein the sealing element comprises a plurality of expandable or breakable bands that are at least partially embedded within the sealing element, and wherein each of the expandable or breakable bands encircles the outer surface of the hanger body.

7. The apparatus of claim 6, wherein one or more of the plurality of expandable or breakable bands are completely embedded within the sealing element.

8. The apparatus of claim 1, wherein the sleeve comprises a metal sleeve.

9. The apparatus of claim 1, wherein the sealing element include a fluid passageway that extends from a distal end of the sealing element into one or more internal passageways that are completely within to the sealing element, the one or more internal passageways configured to apply a force on the second portion of the sealing element in a radially outward direction and away from the hanger body when fluid pressure is present at the fluid passageway.

10. A system comprising:

a partially bonded seal configured to be actuatable to provide a fluid seal between a first conduit and a second conduit positioned within a wellbore, the partially bonded seal comprising a hanger body and a sealing element, the sealing element positioned in contact with and encircling an outer surface of the hanger body for some longitudinal distance along the hanger body, wherein the sealing element comprises a sleeve including a plurality of ring shaped teeth that encircle the outer surface of the hanger body, the teeth configured to engage a surface of the first conduit positioned adjacent to the sleeve when the partially bonded seal is activated, wherein a first portion of the sealing element is adjacent to and is bonded to the outer surface of the hanger body, and wherein a second portion of the sealing element that is adjacent to the outer surface of the hanger body is not bonded to the outer surface of the hanger body; and a seal expansion tool configured to be inserted into a liner passageway extending longitudinally through the hanger body and encircled by the partially bonded seal, the seal expansion tool configured to be moved in a longitudinal direction through the liner passageway in order to radially expand a reduced diameter portion of the hanger body that includes the sealing element and thereby bring one or more surfaces of the sealing element into contact with a surface of the second conduit in order to form the fluid seal between the first conduit and the second conduit.

11. The system of claim 10, wherein the sealing element is bonded at a proximal end of the sealing element to a first metal spike that extends radially outward and encircles the outer surface of the hanger body, and wherein the sealing element extends along the outer surface of the hanger body to a distal end of the sealing element which is not bonded to but is positioned adjacent to a proximally facing surface of a second metal spike that extends radially outward and encircles the outer surface of the hanger body at a longitudinal distance away from the first metal spike.

12. The system of claim 10, wherein the sealing element comprises an elastomeric material or a thermoplastic material.

13. The system of claim 10, wherein the sealing element comprises a plurality of expandable or breakable bands that are at least partially embedded within the sealing element, and wherein each of the expandable or breakable bands encircles the outer surface of the hanger body.

14. The system of claim 13, wherein one or more of the plurality of expandable or breakable bands are completely embedded within the sealing element.

15. The system of claim 10, wherein the sleeve comprises a metal sleeve.

16. A method comprising:

positioning a wellbore liner including an expandable partially bonded seal adjacent to and within a conduit passageway of a conduit positioned with a wellbore, the expandable partially bonded seal comprising a hanger body and a sealing element, the sealing element positioned in contact with and encircling an outer surface of the hanger body for some longitudinal distance along the hanger body, wherein the sealing element comprises a sleeve including a plurality of ring shaped teeth that encircle the outer surface of the hanger body, the teeth configured to engage a surface of the conduit positioned adjacent to the sleeve when the partially bonded seal is activated, wherein a first portion of the sealing element is adjacent to and is bonded to the outer surface of the hanger body, and wherein a second portion of the sealing element is adjacent to and is not bonded to the outer surface of the hanger body;

inserting a seal expansion tool into a liner passageway that extends longitudinally through and is encircled by the expandable partially bonded seal; and actuating the expandable partially bonded seal using the seal expansion tool to expand the hanger body and bring one or more surfaces of the sealing element into contact with a surface of the conduit in order to form a fluid seal between the wellbore liner and the conduit.

17. The method of claim 16, wherein the sealing element comprises an elastomeric material or a thermoplastic material.

18. The method of claim 16, wherein the sealing element comprises a plurality of expandable or breakable bands that are at least partially embedded within the sealing element, and wherein each of the expandable or breakable bands encircles the outer surface of the hanger body.

19. The method of claim 18, wherein one or more of the plurality of expandable or breakable bands are completely embedded within the sealing element.

20. The method of claim 16, wherein the sleeve comprises a metal sleeve.

* * * * *